US009109314B2

(12) United States Patent
Maki

(10) Patent No.: US 9,109,314 B2
(45) Date of Patent: Aug. 18, 2015

(54) EMBROIDERY DATA GENERATOR, SEWING MACHINE AND NON-TRANSITORY COMPUTER-READABLE STORAGE MEDIUM

(71) Applicant: BROTHER KOGYO KABUSHIKI KAISHA, Nagoya-shi, Aichi-ken (JP)

(72) Inventor: Ryutaro Maki, Handa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/540,748

(22) Filed: Nov. 13, 2014

(65) Prior Publication Data

US 2015/0144043 A1 May 28, 2015

(30) Foreign Application Priority Data

Nov. 26, 2013 (JP) ..... 2013-243929

(51) Int. Cl.
*D05C 5/02* (2006.01)
*D05B 19/12* (2006.01)
*D05B 19/02* (2006.01)

(52) U.S. Cl.
CPC ..... *D05B 19/12* (2013.01); *D05B 19/02* (2013.01)

(58) Field of Classification Search
CPC ..... D05B 19/02; D05B 19/04; D05B 19/08; D05B 19/085; D05B 19/10; D05B 19/105; D05C 5/00; D05C 5/02
USPC ..... 700/136–138; 112/102.5, 470.01, 112/470.04, 475.19
See application file for complete search history.

(56) References Cited

U.S. PATENT DOCUMENTS

| | | | | |
|---|---|---|---|---|
| 6,012,402 | A * | 1/2000 | Sekine | 112/102.5 |
| 2012/0197430 | A1 | 8/2012 | Maki et al. | |
| 2014/0069308 | A1 * | 3/2014 | Tokura | 112/102.5 |

FOREIGN PATENT DOCUMENTS

JP A-2012-157451 8/2012

* cited by examiner

*Primary Examiner* — Nathan Durham
(74) *Attorney, Agent, or Firm* — Oliff PLC

(57) ABSTRACT

An embroidery data generator generating embroidery data on which an embroidery pattern is sewn includes a display unit configured to be capable of color display, a control device configured to cause the display unit to display a color chart representing at least one of three attributes of hue, saturation and value of a color, to set a range on the color chart displayed by the display unit, to randomly extract one of colors within the set range, the one color being used as thread color data, the embroidery pattern including a plurality of color-based pattern portions, the thread color data specifying colors of the color-based pattern portions, and to assign the extracted color to the thread color data of a corresponding one of the color-based pattern portions.

11 Claims, 15 Drawing Sheets

| EMBROIDERY DATA | |
|---|---|
| FIRST PATTERN PORTION DATA | PATTERN 1 PURPLE |
| | Xa0, Ya0 |
| | Xa1, Ya1 |
| | Xa2, Ya2 |
| | ⋮ |
| | XaN, YaN |
| SECOND PATTERN PORTION DATA | PATTERN 2 LIME GREEN |
| | Xb0, Yb0 |
| | Xb1, Yb1 |
| | Xb2, Yb2 |
| | ⋮ |
| | XbN, YbN |
| THIRD PATTERN PORTION DATA | PATTERN 3 GREEN |
| | Xc0, Yc0 |
| | Xc1, Yc1 |
| | Xc2, Yc2 |
| | ⋮ |
| | XcN, YcN |
| ⋮ | ⋮ |
| n-TH PATTERN PORTION DATA | PATTERN n YELLOW |
| | Xn0, Yn0 |
| | Xn1, Yn1 |
| | Xn2, Yn2 |
| | ⋮ |
| | XnN, YnN |

FIG. 4

EMBROIDERY DATA GENERATOR, SEWING MACHINE AND NON-TRANSITORY COMPUTER-READABLE STORAGE MEDIUM

CROSS-REFERENCE TO RELATED APPLICATIONS

This application is based upon and claims the benefit of priority from the prior Japanese Patent Application No. 2013-243929 filed on Nov. 26, 2013, the entire contents of which are incorporated herein by reference.

BACKGROUND

1. Technical Field

The present disclosure relates to an embroidery data generator generating embroidery data, a sewing machine and a non-transitory computer-readable storage medium.

2. Related Art

There has conventionally been known a sewing machine which sews an embroidery pattern based on embroidery data. A plurality of data of embroidery patterns is stored in a storage device incorporated in the sewing machine or an external storage device such as ROM card or flexible disc. A user selects a desirable one of the embroidery patterns. The sewing machine enters the embroidery data of the selected embroidery pattern and sews the embroidery pattern on a workpiece cloth, while transferring an embroidery frame holding the workpiece cloth by a transfer mechanism.

An embroidery pattern includes a plurality of color-based pattern portions. Embroidery data of the embroidery pattern includes thread color data specifying a color of each color-based pattern portion. Each color-based pattern portion is sewn in a set color (a thread color) as thread color data. However, the user sometimes wishes to sew an embroidery pattern in favorite colors which do not correspond with the predetermined colors or in eccentric colors regarding the colors of the color-based pattern portions. When colors of the embroidery pattern are specified in this manner, data of the color-based pattern portions are required to be read one by one. Regarding each read data, the corresponding thread color data needs to be confirmed and specified, with the result that the color editing manner is time-consuming and troublesome.

SUMMARY

A conventional embroidery data generator is configured to automatically extract and assign a color to be used as thread color from a plurality of colors stored in a storage unit, for every thread color data of the color-based pattern portion.

More specifically, when the color of each color-based pattern portion of an embroidery pattern is set to a new one, the user selects one of "vivid," "soft" and "gradation" regarding a color category. Each one of the color categories is set as a threshold indicative of a color range as an HSV color model. For example, in the category of "soft," a threshold is set so that the difference between saturation values of an extracted color becomes smaller. When the user selects the category of "soft," the embroidery data generator carries out color extraction from the color range. The embroidery data generator assigns extracted color to every thread color data of each color-based pattern portion. Coloration is automatically carried out so that an entire embroidery pattern exhibits soft color shades.

However, the aforementioned threshold is a predetermined value. Accordingly, there is a case where the color extracted from the color range would not correspond to that desired by the user. Accordingly, there is a possibility that a coloration pattern the user desires for the embroidery pattern cannot be obtained.

Therefore, an object of the disclosure is to provide an embroidery data generator which can easily provide a variety of coloration patterns using colors the user desires for an embroidery pattern, a sewing machine and a non-transitory computer-readable storage medium.

The present disclosure provides an embroidery data generator generating embroidery data on which an embroidery pattern is sewn, the generator including a display unit configured to be capable of color display and a control device configured to cause the display unit to display a color chart representing at least one of three attributes of hue, saturation and value of a color in an HSV color space, to set a range on the displayed color chart, to randomly extract one of colors within the set range, the one color being used as thread color data, the embroidery pattern including a plurality of color-based pattern portions, the thread color data specifying colors of the color-based pattern portions, and to assign the extracted color to the thread color data of a corresponding one of the color-based pattern portions.

The disclosure also provides a non-transitory computer-readable storage medium storing a program for an embroidery data generator including a display unit capable of color display and a control device, the program causing the control device to execute instructions which, when executed, cause the control device to cause the display unit to display a color chart representing at least one of three attributes of hue, saturation and value of a color in an HSV color space, to set a range on the color chart displayed by the display unit, to randomly extract one of colors within the set range, the one color being used as thread color data, the embroidery pattern including a plurality of color-based pattern portions, the thread color data specifying colors of the color-based pattern portions, and to assign the extracted color to the thread color data of a corresponding one of the color-based pattern portions.

The disclosure further provides a sewing machine comprising a sewing unit capable of executing sewing on a workpiece cloth, a display unit capable of color display, and a control device configured to cause the display unit to display a color chart representing at least one of three attributes of hue, saturation and value of a color in an HSV color space, to set a range on the color chart displayed by the display unit, to randomly extract one of colors within the set range, the one color being used as thread color data, the embroidery pattern including a plurality of color-based pattern portions, the thread color data specifying colors of the color-based pattern portions, to assign the extracted color to the thread color data of a corresponding one of the color-based pattern portions, and to control the sewing unit so that an embroidery pattern is sewn on the workpiece cloth, based on embroidery data of the embroidery pattern including color-based pattern portions to which the extracted colors have been assigned respectively.

BRIEF DESCRIPTION OF THE DRAWINGS

In the accompanying drawings:

FIG. 4 illustrates an example of embroidery data;

DETAILED DESCRIPTION

Figure 1:
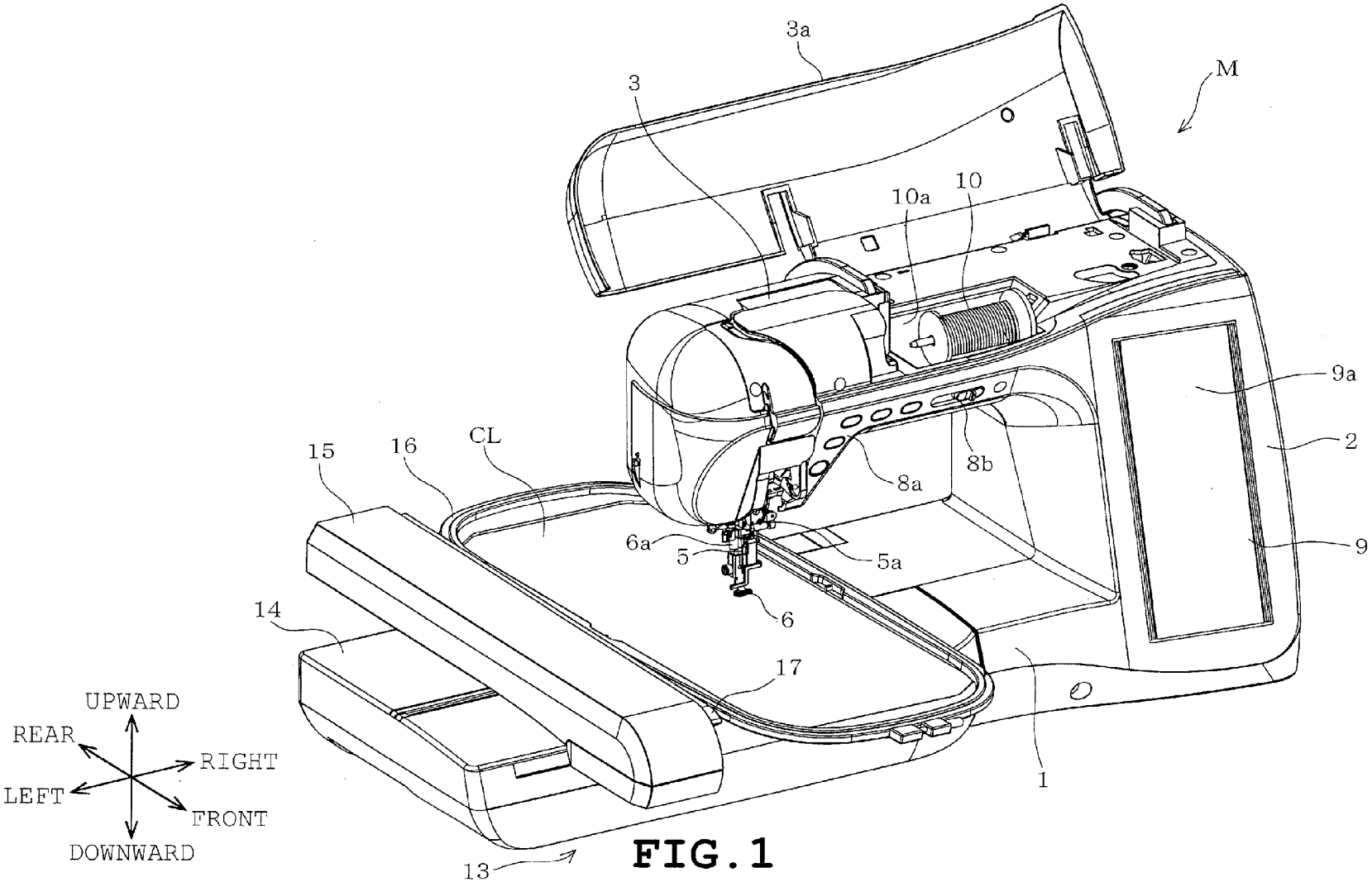
FIG. 1 is a perspective view showing an appearance of the sewing machine according to one embodiment.

A first embodiment of a household sewing machine (hereinafter, "sewing machine M") will be described with reference to FIGS. 1 to 13. Referring to FIG. 1, the sewing machine M includes a bed 1 extending in a right-left direction, a pillar 2 standing from a right end of the bed 1 and an arm 3 extending leftward from an upper part of the pillar 2, all of which are formed integrally with one another. The arm 3 houses a sewing machine shaft (not shown) extending in the right-left direction. A sewing machine motor 4 (see FIG. 2) which rotates the machine shaft is provided in the pillar 2. The side where the user is located relative to the sewing machine M, namely, the side of switches or a display unit will be referred to as "front" and the side opposed to the front will be referred to as "rear." The side where the pillar 2 is located will be referred to as "right side" and the side opposed to the right side will be referred to as "left side."

The arm 3 has a distal end on which are mounted a needle bar 5*a* having a lower end to which a needle 5 is attached and a presser bar 6*a* having a lower end provided with a presser foot 6. The arm 3 houses a needle bar driving mechanism, a needle bar swinging mechanism, a needle thread take-up driving mechanism, a presser bar driving mechanism and the like although none of them are shown. The needle bar driving mechanism moves the needle bar 5*a* upward and downward based on rotation of the machine shaft. The needle bar swinging mechanism swings the needle bar 5*a* in a direction (the right-left direction) perpendicular to a cloth feed direction. The needle thread take-up driving mechanism moves a needle thread take-up (not shown) upward and downward in synchronization with the upward and downward movement of the needle bar 5*a*. The presser bar driving mechanism moves the presser bar 6*a* upward and downward.

The arm 3 is provided with a cover 3*a* which is pivotally mounted thereon to open and close an upper surface side thereof. A housing space 10*a* is defined in the central front of the arm 3 so as to house a thread spool 10 when the cover 3*a* is in an open state. A needle thread drawn from the thread spool 10 is supplied to the needle 5 through a thread supply passage including the needle thread take-up and the like. On the front side of the arm 3 are mounted various switches including a start/stop switch 8*a* and a speed adjusting knob 8*b*. The start/stop switch 8*a* is operable to start or stop a sewing work. The speed adjusting knob 8*b* is operable to adjust a sewing speed or a rotational speed of the machine shaft.

A large sized vertically long color liquid-crystal display 9 capable of full color display is provided on the front of the pillar 2. The display 9 serves as a display unit displaying information by multiple colors. The display 9 is configured to display various sewing patterns such as ordinary patterns or embroidery patterns and names of functions to be executed in the sewing work. The display 9 is also configured to display a setting screen for setting regarding a coloration process as will be described later, and the like. The display 9 has a front to which is mounted a touch panel 9*a* (see FIG. 2) having a plurality of touch keys including transparent electrodes. The touch keys are depressed by user's finger or a touch pen (not shown). The depression of the touch keys will hereinafter be referred to as "touch operation." Thus, selection of an embroidery pattern, instructions of various functions, setting of various parameters or the like is realized by the touch operation.

The pillar 2 has a right side surface formed with a card slot 12 (see FIG. 2) into which a memory card 11 storing embroidery data of various embroidery patterns and the like is insertable.

The bed 1 has an upper surface on which a needle plate (not shown) is mounted. The bed 1 houses a cloth feed mechanism, a horizontal rotating hook, a thread cutting mechanism and the like, all of which are located under the needle plate. The cloth feed mechanism moves a feed dog vertically and horizontally. The horizontal rotating hook housing a bobbin forms stitches in cooperation with the needle 5. The thread cutting mechanism cuts a needle thread and a bobbin thread.

An embroidery frame transfer device 13 is detachably attached to a left part of the bed 1. The embroidery frame transfer device 13 includes a body 14 that is level with the upper surface of the bed 1 in an attached state thereof and a movable portion 15 which is mounted on an upper surface of the body 14 so as to be movable in the right-left direction. The movable portion 15 is provided with a carriage 17 which is movable in the front-back direction to detachably connect an embroidery frame 16 thereto. The embroidery frame 16 is configured to hold a workpiece cloth CL serving as an object to be sewn. In the body 14 is provided an X-direction transfer mechanism (not shown) which moves the carriage 17 in the right-left direction together with the movable portion 15 and a Y-direction transfer mechanism (not shown) which moves the carriage 17 in the front-back direction. The X-direction and Y-direction transfer mechanisms are provided with respective drive motors (an X-axis motor 18 and a Y-axis motor 19 as will be described later; and see FIG. 3). The embroidery frame 16 is moved in the right-left or X direction and in the front-back or Y direction by driving the respective drive motors on the basis of the embroidery data of the embroidery pattern. The X-direction and Y-direction transfer mechanisms constitute a sewing unit for sewing an embroidery pattern, together with the needle bar driving mechanism and the presser bar driving mechanism.

Figure 2:
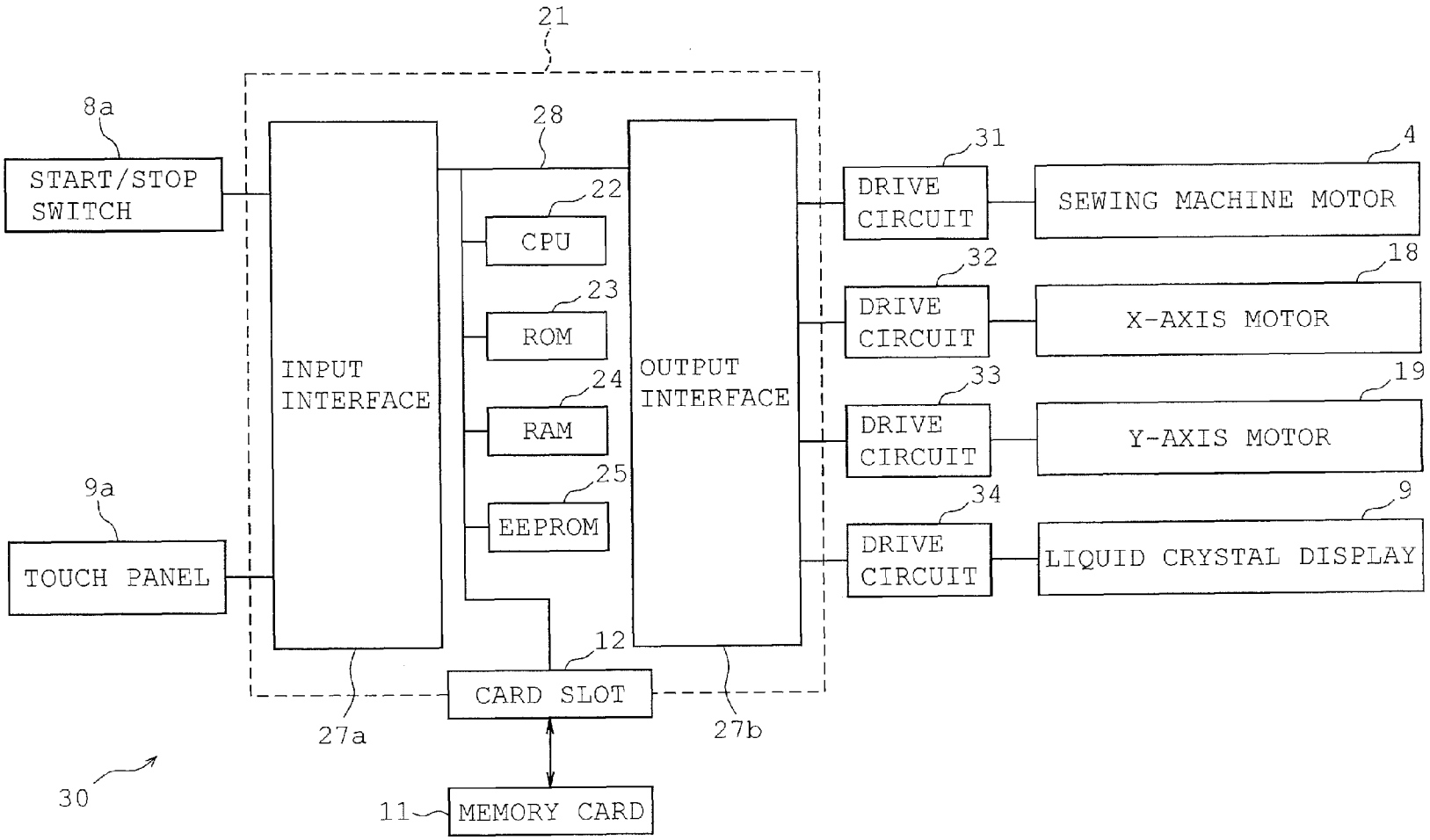
FIG. 2 is a block diagram showing an electrical arrangement of the sewing machine.

The arrangement of a control system of the sewing machine M will now be described with reference to the block diagram of FIG. 2. A control device 21 is configured mainly with a microcomputer and incorporates a CPU 22, a ROM 23, a RAM 24, an EEPROM 25, the card slot 12, an input interface 27*a*, an output interface 27*b*, a bus bar 28 connecting between the input and output interfaces 27*a* and 27*b*, and the like. The start/stop switch 8*a* and the touch panel 9*a* are connected to the input interface 27*a*. To the output interface 27*b* are connected drive circuits 31, 32, 33 and 34 driving the sewing machine motor 4, the X-axis motor 18, the Y-axis motor 19 and the display 9 respectively. The control device 21, the display 9 and the drive circuit 34 serve as a display unit. An embroidery data generator 30 is comprised of the control device 21, the touch panel 9*a*, the display 9 and the drive circuit 34.

The ROM 23 stores embroidery data, an embroidery data generating program, a sewing control program, a display control program and a table of full thread information. The embroidery data generating program causes the computer to function as various processing units to generate embroidery data. The full thread information table relates to all pieces of information about a plurality of types of threads used for embroidery sewing and includes thread color information as will be described later. The display control program is used to control the display 9. These programs and data may be stored by another storage unit. The storage unit may include an internal storage unit such as an EEPROM 25 and an external storage unit such as the memory card 11. For example, when the embroidery data generating program is stored in the external storage unit, the control device 21 reads the program onto the RAM 24 to execute the program.

Figure 3:
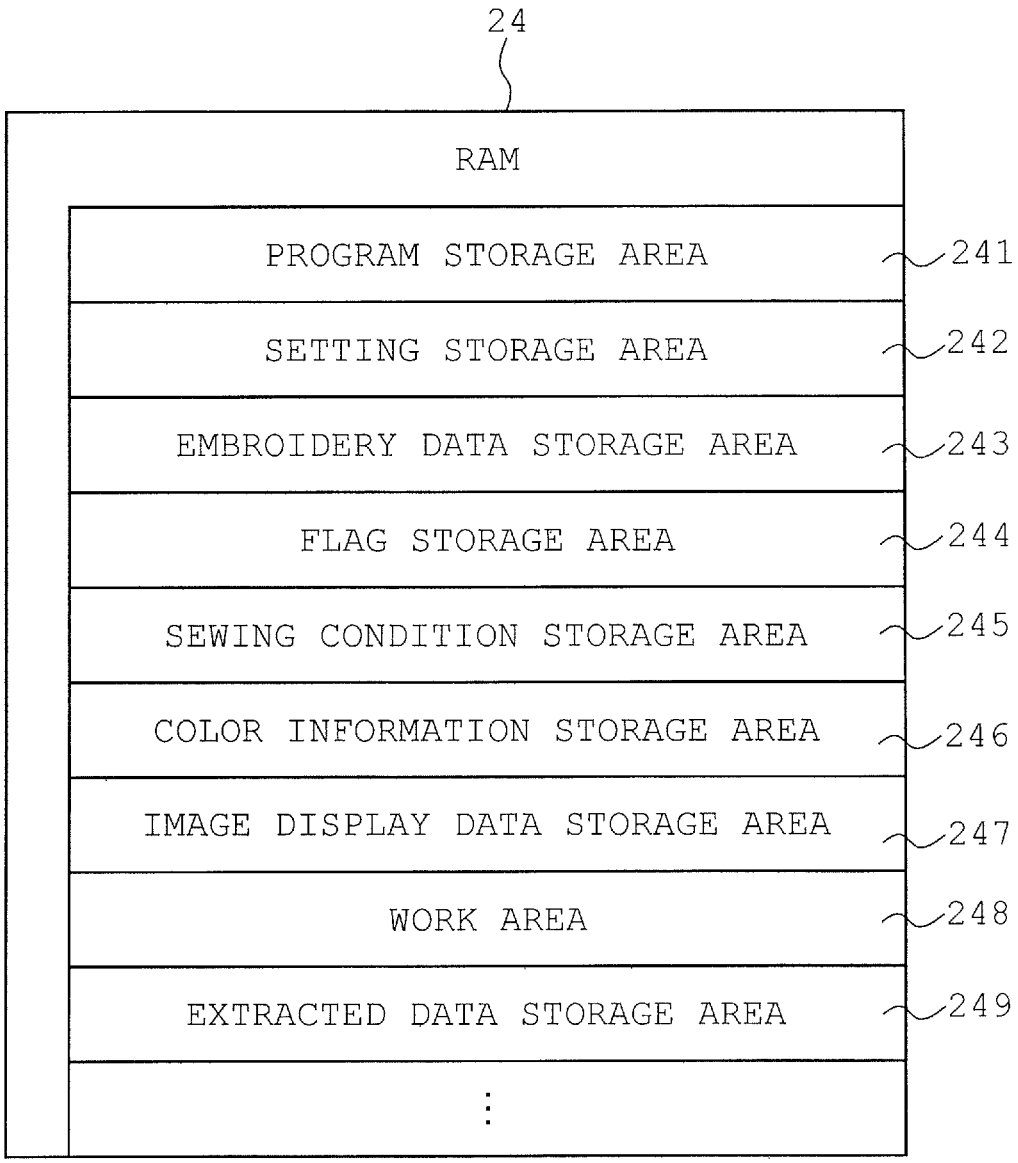
FIG. 3 is a conceptual diagram showing a storage area of RAM of the sewing machine.

The RAM 24 has a storage area for temporarily storing the aforementioned programs and data. The RAM 24 also has storage areas for storing various set values supplied by operation on the touch panel 9*a* and the like and results of calculation performed by the control device 21 and the like. In more detail, as shown in FIG. 3, the RAM 24 has a program storage area 241, a setting storage area 242, an embroidery data storage area 243, a flag storage area 244, a sewing condition storage area 245, a color information storage area 246, an image display data storage area 247, a work area 248, an extracted data storage area 249 and the like. The program storage area 241 stores various programs read from the ROM 23 or the like. The setting storage area 242 stores settings, tables and the like referred to during execution of a program. The embroidery data storage area 243 stores data serving as an original or a reference value in generation of a color of embroidery data. The flag storage area 244 stores various flags used in execution of a program. The sewing condition storage area 245 stores various sewing conditions in the case of sewing an embroidery pattern.

The color information storage area 246 stores data used for coloration of an embroidery pattern and more specifically, a pallet table and pallet-based color numbers both of which will be described later, and the like. Furthermore, the extracted data storage area 249 temporarily stores data of a color randomly extracted from the pallet table or the like. The image display data storage area 247 stores image data of screens to be displayed on the display 9 and display settings. The work area 248 preliminarily stores settings and the like during execution of various programs.

Figure 8:
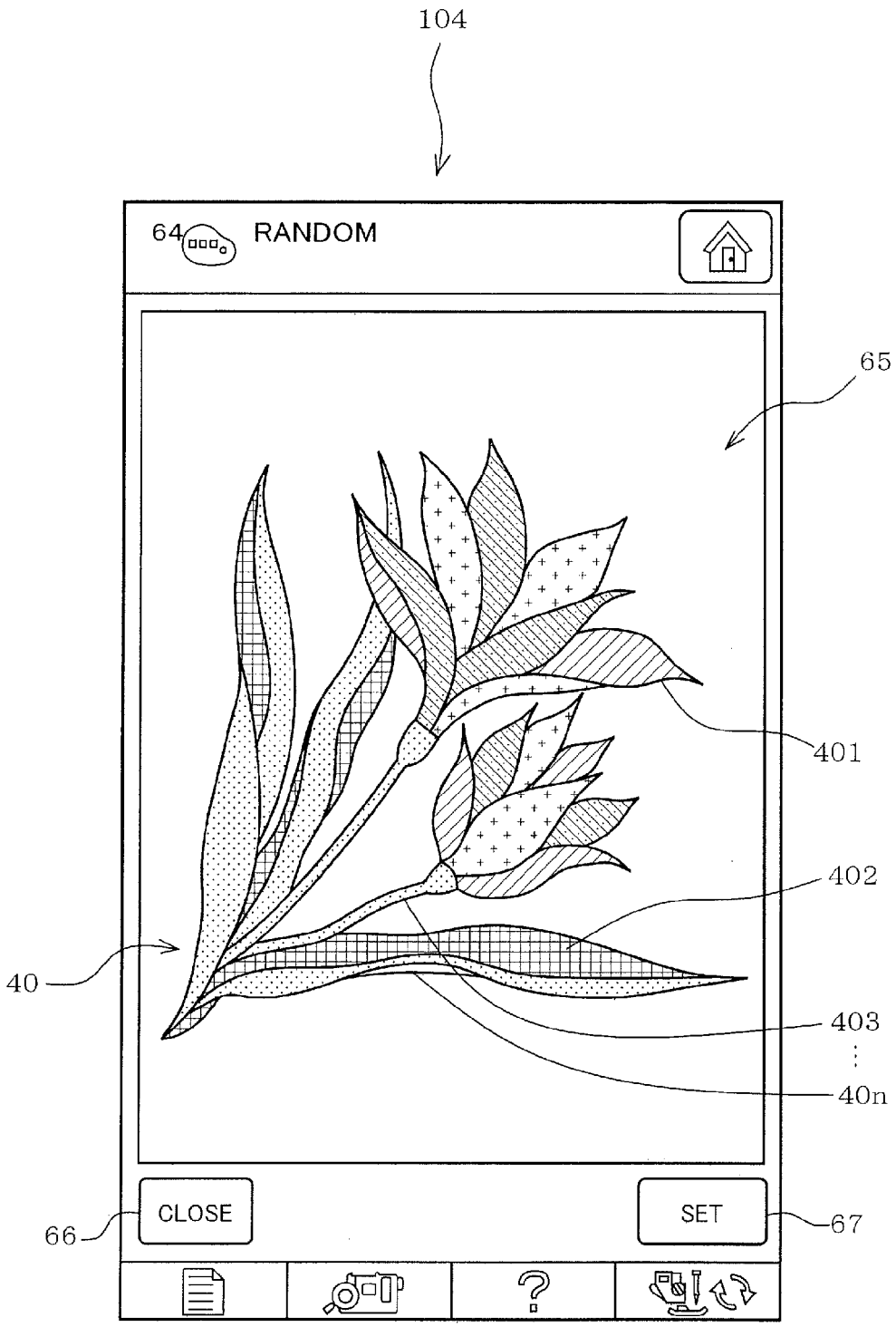
FIG. 8 illustrates an enlarged display screen.

An embroidery pattern 40 of "flower" displayed on a screen 104 of the display 9 as shown in FIG. 8 will be described as an example of embroidery pattern. The embroidery pattern 40 includes first to n-th pattern portions 401 to 40*n* which are a plurality of (n number of) color-based pattern portions. More specifically, for example, a first pattern portion 401 composing flower petal is sewn by the use of a purple thread. A second pattern portion 402 composing a leaf is sewn by the use of a yellow-green thread. A third pattern portion 403 composing a stalk is sewn by the use of a green thread. Thus, although the pattern portions 401 to 40*n* are color-based pattern portions for which respective colors are set, the pattern portions 401 to 40*n* may or may not have colors different from one another.

Embroidery data is used for the sewing machine M to sew an embroidery pattern and includes data of a plurality of color-based pattern portions. For example, as shown in FIG. 4, embroidery data of the embroidery pattern 40 includes data of a plurality of needle locations set for respective pattern portions 401 to 40*n*, sewing sequence data to specify a sewing sequence of the pattern portions 401 to 40*n* and thread color data. The thread color data is also used to specify a color for every color-based pattern portion, and a color of the thread color data is assigned from color information to the thread color data by an assignment unit which will be described later.

An uppermost sewing sequence data "pattern 1" in FIG. 4 is to specify a sequence of pattern to be initially sewn. "Purple" corresponding to the sequence is actually thread color data indicated by RGB values, for example. Furthermore, needle location data "Xa0, Ya0" . . . "XaN, YaN" is position coordinates where a needle corresponding to a purple thread sequentially drops. In the same manner, each of second and subsequent embroidery data includes sewing sequence data "pattern 2" to "pattern n," thread color data "yellow-green" to "yellow" and needle location data "XbN, YbN" to "XnN, YnN." Furthermore, the embroidery data includes image data to be displayed on the display 9 (image data of bmp or the like, for example), and an image of embroidery pattern is displayed on the display 9 in colors assigned to respective thread color data.

The EEPROM 25 stores information (color information) about a plurality of colors assigned as thread color data. The EEPROM 25 and the RAM 24 each serve as a color storage unit. Color information relates to thread colors of thread spools 10 which can be used with the sewing machine M and is defined as RGB values. More specifically, the EEPROM 25 stores a first pallet table (see a first color pallet 53 in FIG. 5) composed of RGB values of sixty-four colors and pallet-based color numbers of 1 to 64 corresponding to the respective RGB values. The EEPROM 25 also stores a second pallet table (not shown) of a plurality of colors selected from the color information by the user in addition to the first pallet data. The second pallet table is a custom pallet table including RGB values of up to three-hundred colors and pallet-based color numbers of 1 to 300 corresponding to the respective RGB values, both of which values are settable according to user's preference.

Screens displayed on the display 9 in generating embroidery data or in particular, coloration of thread color data will be described with reference to FIGS. 5 to 8 in addition to FIGS. 1 to 4. FIGS. 5 to 8 explain display screens 101 to 104 of the display 9. Since the display 9 is a liquid crystal color display, images of embroidery patterns, the first color pallet 53, and the like on the screens 101 to 104 are displayable in multiple colors.

Figure 5:
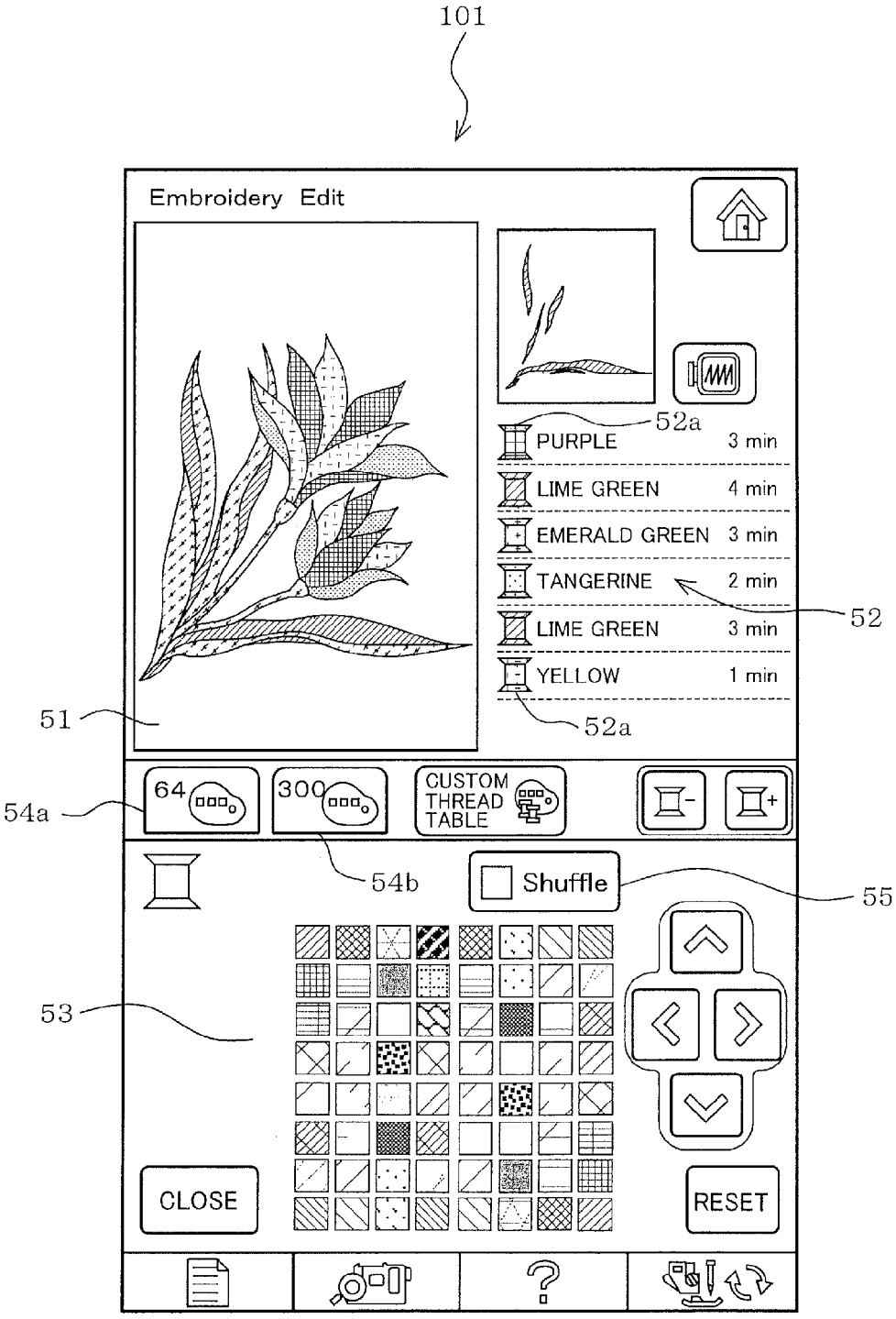
FIG. 5 illustrates a first color change screen.

FIG. 5 exemplifies the first color change screen 101 displayed in the coloration of thread color data. The first color change screen 101 is provided with a preview image area 51 and a thread color data designation area 52, the first color pallet 53, a plurality of pallet selecting keys 54*a* and 54*b* and a shuffle key 55. A preview image displayed in the preview image area 51 shows a result of embroidering in the case where embroidering is executed based on the embroidery data corresponding to an embroidery pattern selected by the user.

Various settings regarding a thread color are settable on the first color change screen 101. More specifically, the thread color data designation area 52 shows colors corresponding to color-based pattern portions of the embroidery pattern in the preview image area 51, together with an illustration of the thread spool 52*a*. When touching the touch key corresponding to the thread spool 52*a*, the user can designate a desirable color in the first color pallet 53 for every color-based pattern portion. For example, the first color pallet 53 has a top row to which RGB values of pallet-based color numbers 1 to 8 of the first pallet table are assigned sequentially from the left one respectively, as shown in FIG. 5. Thus, the first color pallet 53 is a 64-color pallet in which eight pieces of color information are assigned to each of eight rows from the top row to the bottom row.

Figure 6A:
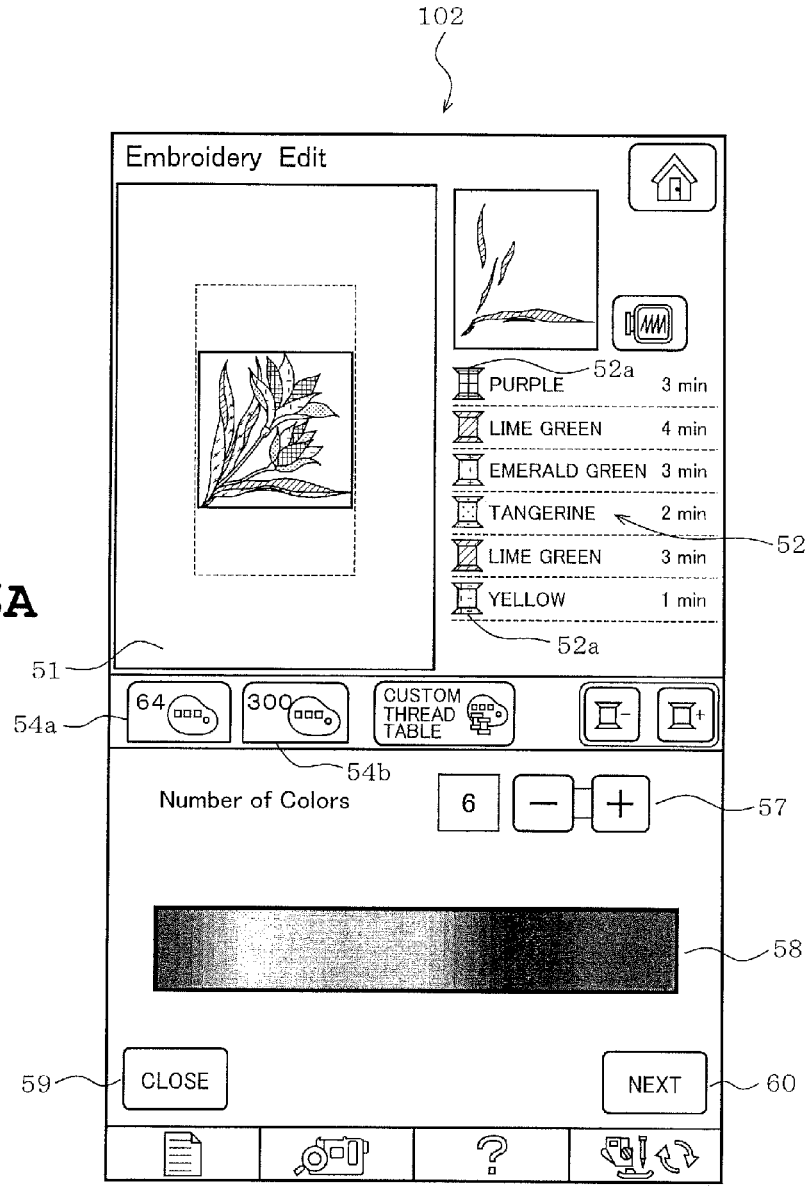
FIGS. 6A and 6B illustrate a range setting screen and a hue bar in the screen respectively.

A second color change screen provided with a second color pallet is prepared separately from the first color change screen although not shown. The second color pallet of the second color change screen has 300 squares capable of arranging up to 300 colors in 300 squares on the basis of the RGB values of the color information. The second color pallet thus corresponds to the second pallet table. When one of a pair of pallet selecting keys 54*a* and 54*b* is touched, the display 9 is switched between the first color change screen 101 and the second color change screen. When the shuffle key 55 is touched, the display 9 is switched to a range setting screen 102 as shown in FIG. 6A.

The range setting screen 102 is also provided with a preview image area 51 and the like as the first color change screen 101. The range setting screen 102 is further provided with a color number setting part 57, a hue bar 58, a CLOSE key 59 and a NEXT key 60, instead of the first color pallet 53. A total number of types of colors used as thread color data of embroidery data is set when a plus sign key and/or a minus sign key is touched. The total number has an upper limit that is a total number of color-based pattern portions in the embroidery pattern (corresponding to "n" in FIG. 4) and a lower limit of "1." For example, when the color number setting part 57 is set at six colors as shown in FIG. 6A, the embroidery pattern is colored using the six colors.

Figure 7:
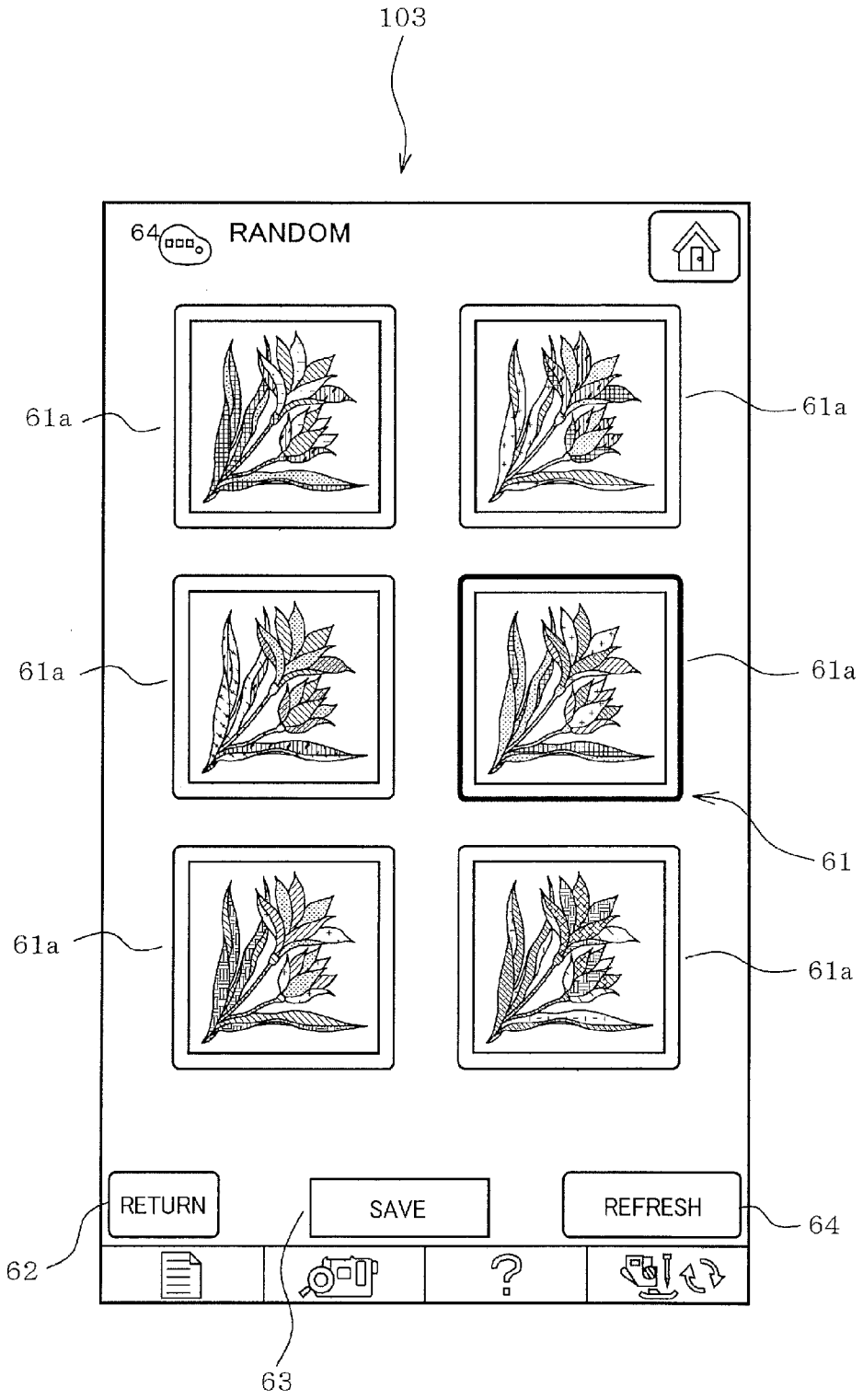
FIG. 7 illustrates a thumbnail display screen.

The hue bar 58 is a color chart made by developing a hue circle into a bar shape, as will be described in detail later. When any point, for example, two points on the hue bar 58 are designated by the touch operation, a range between the two points on the hue bar 58 is set. When the CLOSE key 59 is touched, the display 9 returns to the first color change screen 101. When the NEXT key 60 is touched, a color is randomly extracted as thread color data from colors within the range set on the hue bar 58. Subsequently, the display 9 is switched to a thumbnail display screen 103 as shown in FIG. 7.

The thumbnail display screen 103 is provided with an embroidery pattern selection area 61 in which a plurality of embroidery patterns (six, for example) is displayed, a RETURN key 62, a SAVE key 63, a REFRESH key 64 and the like. The embroidery pattern selection area 61 displays thumbnail images 61*a* obtained by scaling down the embroidery patterns. These thumbnail images 61*a* represent six embroidery patterns differing in the combination of colors generated using the colors randomly extracted as the thread color data. When the SAVE key 63 and one of the thumbnail image 61*a* are touched on the thumbnail display screen 103 in turn, embroidery data of an embroidery pattern corresponding to the touched thumbnail image 61*a* is stored in the EEPROM 25. Furthermore, when the REFRESH key 64 is touched, newly extracted colors are assigned to the thread color data. As a result, the currently displayed six embroidery patterns are replaced by new six embroidery patterns. When the RETURN key 62 is touched, the display 9 returns to the range setting screen 102. When one of the thumbnail images 61*a* of the embroidery patterns is touched, the display 9 is switched to an enlarged display screen 104 as shown in FIG. 8.

The enlarged display screen 104 is provided with an enlarged image area 65, a CLOSE key 66, a SET key 67 and the like. An enlarged embroidery pattern is displayed in the colors assigned by an assignment process in the enlarged image area 65. When the SET key 67 is touched, the embroidery data of the embroidery pattern is stored in the EEPROM 25 and the display 9 returns to the first color change screen 101.

HSV values are also used in the embodiment in addition to the RGB values. The HSV values are defined by hue, saturation and value in an HSV space, corresponding to the RGB values. The hue bar 58 is configured as a setting unit which sets a range of color phase. More specifically, the HSV values are computed on the basis of RGB values by a known obtaining method and represented by values of hue H, saturation S and value V. In this case, the hue represents a type of color such as red, purple, blue, etc. and has a value ranging from 0 to 360, for example. The saturation represents color vividness and has a value ranging from 0.0 to 1.0. The value represents color brightness and has a value ranging from 0.0 to 1.0.

Figure 6B:
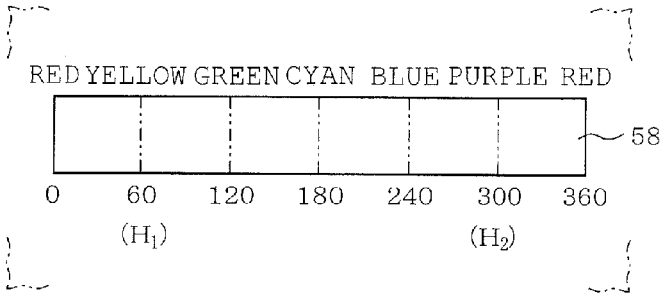

FIG. 6B explains the hue bar 58. Numerals 0 to 360 affixed below the hue bar 58 indicate values of hue H. In the hue bar 58, the numerals are arranged from the leftmost "0" corresponding to red to "60" corresponding to yellow, "120" corresponding to green, "180" corresponding to cyan, "240" corresponding to blue, "300" corresponding to purple and "360" corresponding to red again, sequentially in this order. There is no demarcation between colors adjacent to each other. For example, a number of types of colors representing continuous hue changes exist between red and yellow. Each of saturation S and value V is set at 1.0 over an entire range of the hue bar 58, for example. The RAM 23 stores hue H of each pixel of the hue bar 58 in image data of the hue bar 58 and the abscissa of the hue bar 58 in a correspondence relationship.

When the user designates two points on the hue bar 58 by a touch operation, the control device 21 specifies pixels of the two points on the hue bar 58 corresponding to coordinate values of the designated points, obtaining hues H1 and H2 of the respective pixels. As a result, the obtained hues H1 and H2 are set as thresholds to determine a range on the hue bar 58. The control device 21 then calculates hues H for sixty-four colors of the first pallet table or for three hundred colors of the second pallet table. The control device 21 further selects colors whose calculated hues H are within the range between the thresholds H1 and H2. The current hue table is updated to a designated one composed of the colors within the hue range desired by the user on the basis of the colors selected as described above and new correlated pallet-based color numbers.

The control device 21 generates random numbers using a function with the maximum pallet-based color number serving as an argument, regarding the designated hue table generated on the basis of the designation on the hue bar 58. The control device 21 collates the pallet-based color numbers corresponding to the random numbers, extracting the colors of the corresponding pallet-based color numbers. The colors thus extracted in the random manner are assigned to the color-based pattern portions 401 to 40*n* as the thread color data.

Of three attributes of color, saturation is an index indicative of a chromatic color by a numerical value up to 1.0 according to a degree of vividness with an achromatic color being set at 0.0. Luminance is an index indicative of chromatic luminosity while an ideal white or a brightest color is represented by 1.0. A color chart is an image representing at least one of the attributes, hue, saturation and value in the embodiment. A color chart to designate ranges of saturation and value may be used, instead of the hue bar 58 as will be described in detail later.

The working of the embroidery data generating program will be described with particular attention to coloration relevant to the thread color data with reference to FIGS. 9 to 13, which are flowcharts showing the processing procedure the control device 21 executes based on the embroidery data generating program.

The user firstly touches the touch panel 9*a* so that the embroidery data is read from the ROM 23, whereby the control device 21 causes the display 9 to display an embroidery pattern selecting screen (not shown) according to the embroidery data. The user then selects a desired one of a plurality of embroidery patterns on the pattern selecting screen by touch operation. The touch operation changes the display 9 to a first color change screen 101 displaying the selected embroidery pattern as shown in FIG. 5. Various setting processes are carried out on the first color change screen 101 before coloration of the embroidery pattern (step A1 in FIG. 9).

More specifically, when not wishing to change the colors of the color-based pattern portions of the embroidery pattern in a preview image area of the first color change screen 101, the user designates the colors of the thread spools 52*a* displayed in the corresponding thread color data designating area 52 by touch operation. The colors designated in this manner are stored in an extracted data storage area 249. An upper limit of designated number of colors equals the total number of color-based pattern portions of the embroidery pattern. Accordingly, when determining that color designation has been carried out with respect to all the color-based pattern portions at step A1, the control device 21 ends the processing although the ending is not shown.

Thread color data corresponding to the thread spools 52*a* in the thread color data designating area 52 can be designated using the first color pallet 53 or the second color pallet. In this case, the second color pallet (second color change screen) can be displayed when a pallet selection key 54*b* is touched on the first color change screen 101. When a SHUFFLE key 55 is then touched, the control device 21 causes the display 9 to transit from the first color change screen 101 or the second color change screen to a range setting screen 102, proceeding to a range setting process at step A2 (see FIG. 10).

The control device 21 causes the display 9 to display the color number setting part 57 and the hue bar 58 on the range setting screen 102 (step B1). The user touches the plus sign key and/or the minus sign key to set a total number of types of colors to be used for coloration of the embroidery pattern. A hue range to be used for coloration of the embroidery pattern is set by two touch operations on the hue bar 58 (step B2). In more detail, when the first touch operation is carried out on the hue bar 58, coordinate values are output from the touch panel 9*a*. The control device 21 specifies a pixel corresponding to the touch position on the image of the hue bar 58, based on the output coordinate value and the image data of the hue bar 58 to obtain HSV values of the pixel (step B3). Assume now that the HSV values are H1, S1 and V1. In this case, when yellow as shown in FIG. 6B is designated, the values H1, S1 and V1 become "60," "1.0" and "1.0" respectively. When the second touching operation is then carried out (NO at step B4; and step B2), the control device 21 also specifies a pixel corresponding to the touch position to obtain HSV values of the pixel (step B3). Assume that the HSV values are H2, S2 and V2. In this case, when purple in FIG. 6B is designated, the values of H2, S2 and V2 are "300," "1.0" and "1.0" respectively.

When the touch operation is carried out twice on the hue bar 58 (YES at step B4), the control device 21 sets thresholds which become a lower limit and an upper limit of the range of the hue bar 58, based on the obtained values (step B5). Since the saturation values and the luminance values in the image of the hue bar 58 are constant (S1=S2=V1=V2=1.0), the hue value H1 is set as the threshold of the lower limit and the hue value H2 is set as the threshold of the upper limit.

Since the first color change screen 101 transfers to the range setting screen 102 at step A1, assume that the control device 21 has set the first color pallet 53 as a pallet used for coloration. In this case, the control device 21 reads RGB values corresponding to pallet-based color number 1 of the first pallet table (step B6) to calculate a hue value H based on the read RGB values (step B7). The control device 21 then determines whether or not the calculated hue value H is within the range between the thresholds H1 and H2 (step B8). When the hue value H is within the range between the thresholds H1 and H2 regarding the color of pallet-based color number 1 (YES at step B8), the color of pallet-based color number 1 is stored in the color information storage area 246 of the RAM 24 (step B9). In other words, when the color of pallet-based color number 1 is located between yellow corresponding to the lower limit threshold H1 and purple corresponding to the upper limit threshold H2 in the hue bar 58, the color of pallet-based color number 1 is stored in the color information storage area 246 by the control device 21.

On the other hand, when determining at step B8 that the hue value H is outside the range between the thresholds H1 and H2 (NO), the control device 21 proceeds to step B10 without storing the color of pallet-based color number 1 in the color information storage area 246. Regarding the color of pallet-based color number 2 (NO at step B10; and step B11), too, the control device 21 calculates a hue value H based on the read RGB values, in the same manner as the color of pallet-based color number 1 (step B7). The control device 21 determines whether or not the hue value H of the color of pallet-based color number 2 is within the range between the thresholds H1 and H2, thereby determining whether or not the color of pallet-based color number 2 is stored in the color information storage area 246 (step B8). Steps B7 to B11 are repeated regarding the sixty-four colors in the first color pallet 53, and the corresponding color is stored at step B9 every time the control device 21 determines in the affirmative at step B8. As a result, the first pallet table is updated to a designated hue table of selected colors within the hue designated on the hue bar 58 to be stored in the color information storage area 246 together with a post-update pallet-based color number.

Figure 9:
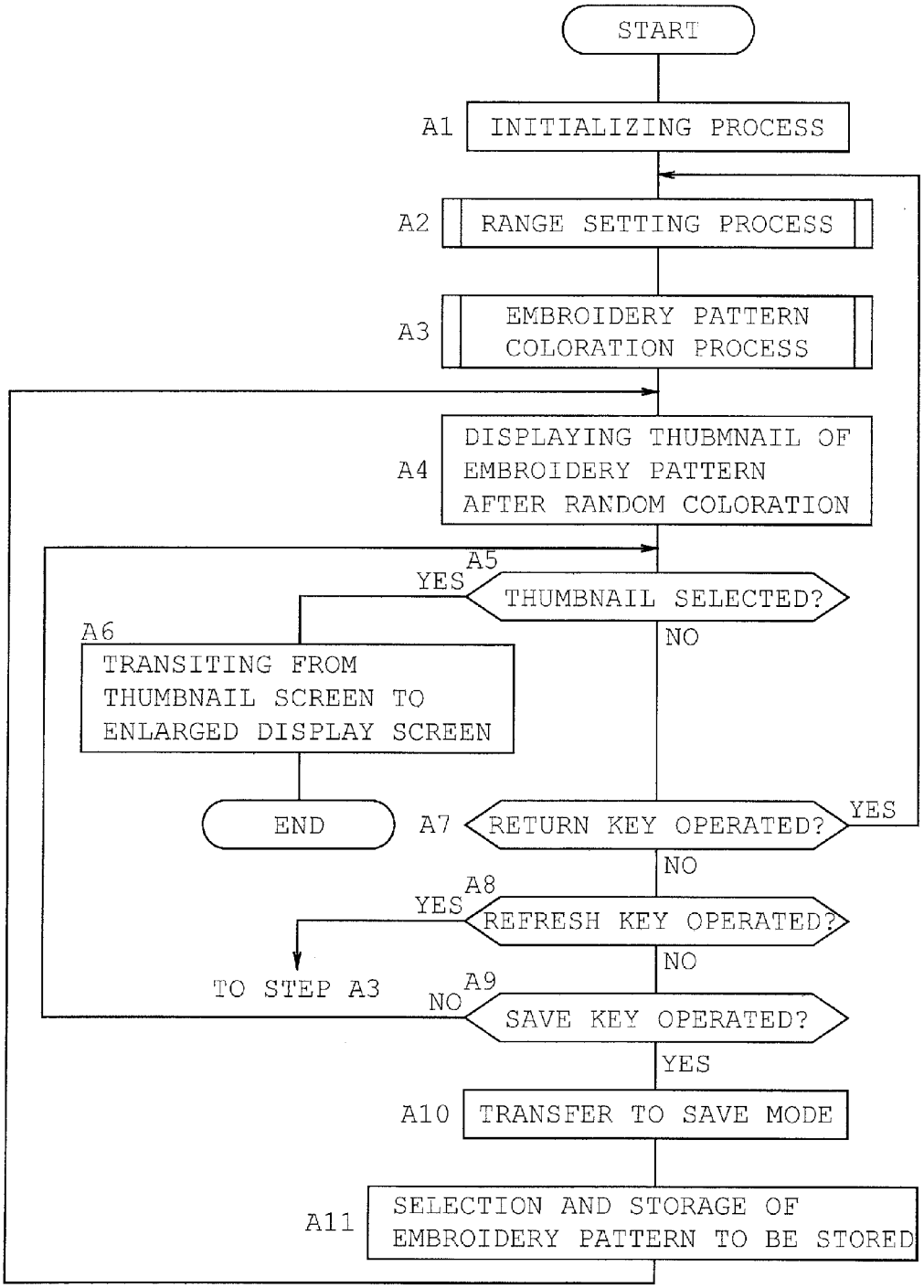
FIG. 9 is a flowchart showing setting of thread color data.
Figure 10:
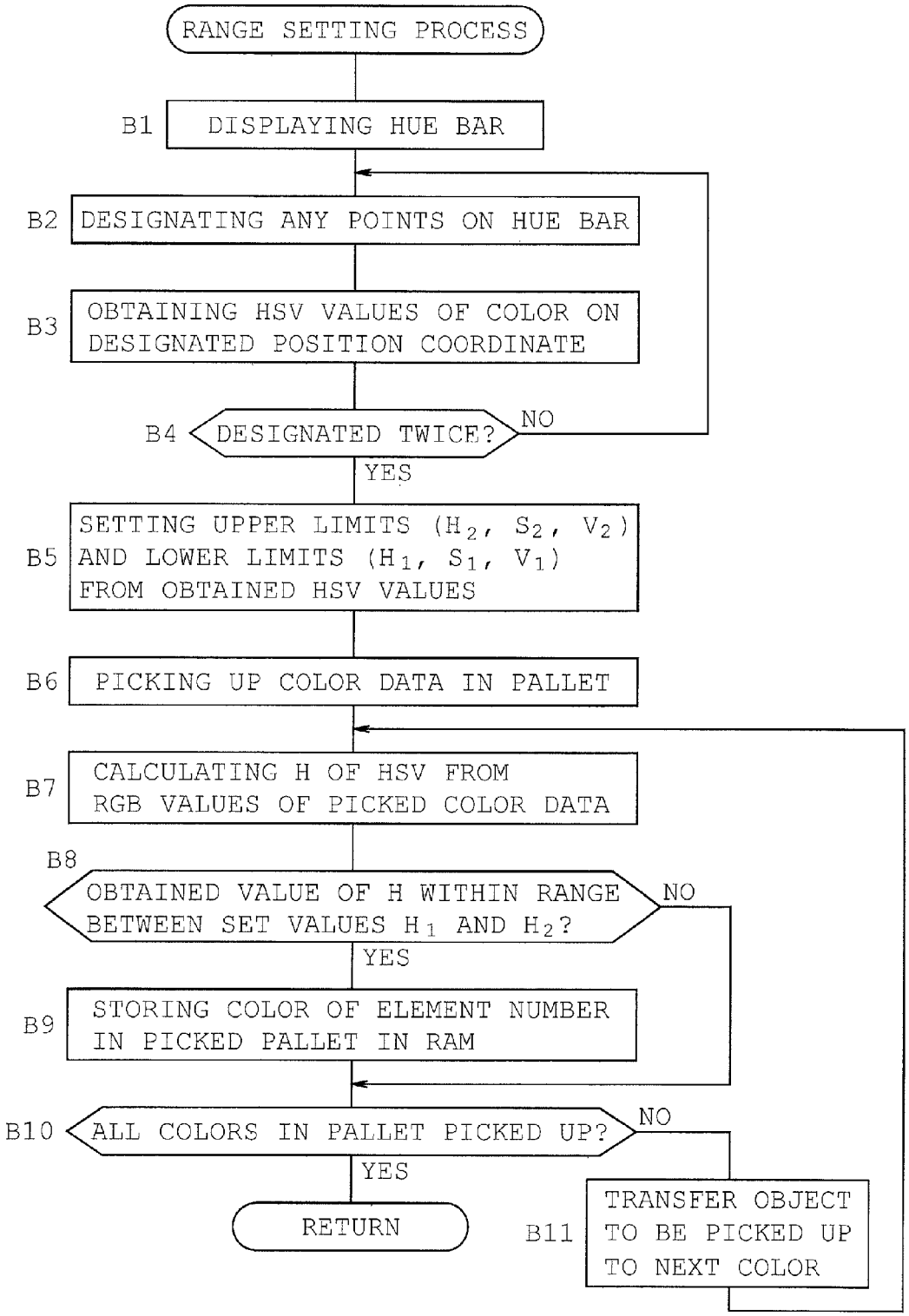
FIG. 10 is a flowchart showing a range setting process.
Figure 11:
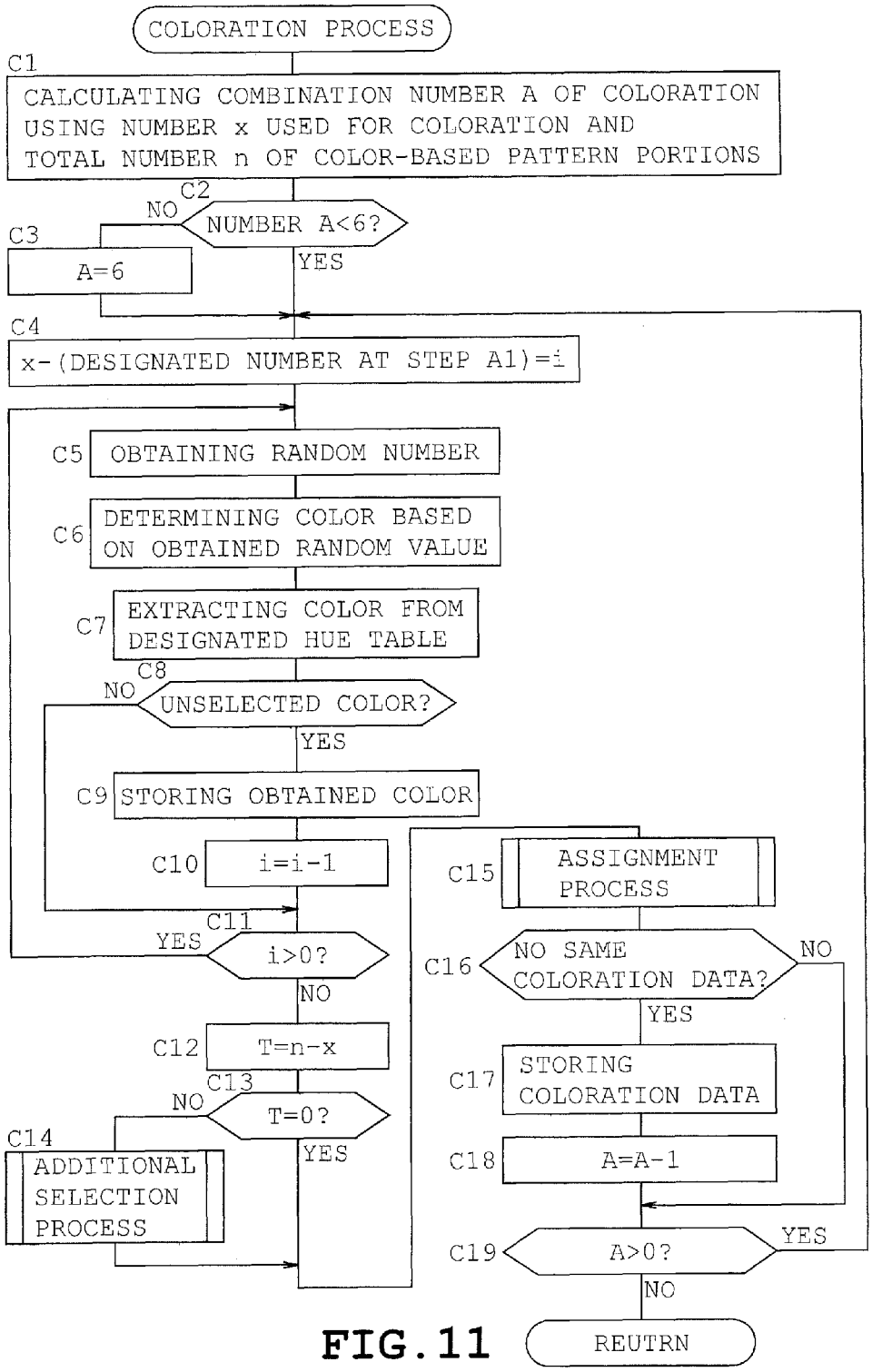
FIG. 11 is a flowchart showing a coloring process.
Figure 12:
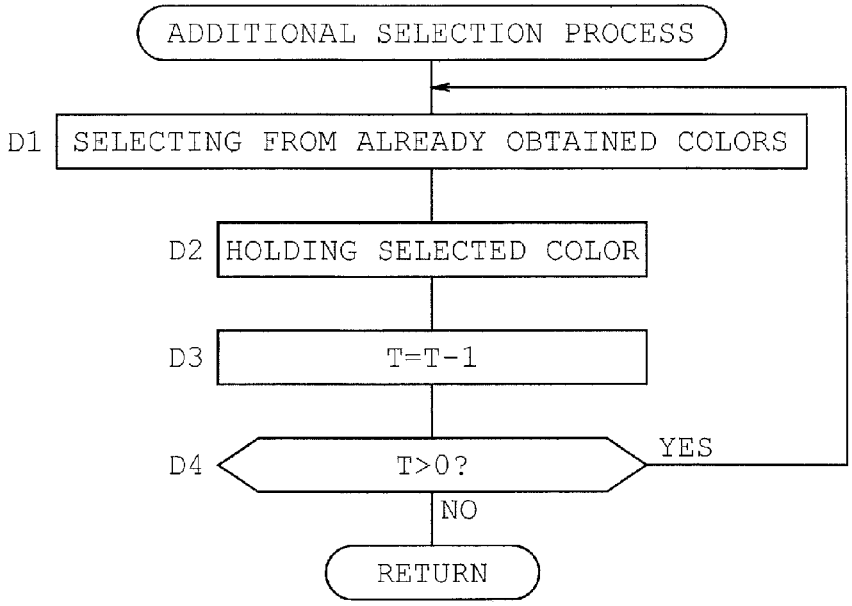
FIG. 12 is a flowchart showing an additional selecting process.

The control device 21 returns to step A3 in FIG. 9 when having completed selection regarding the sixty-four colors in the first pallet 53 (YES at step B10). When the second color pallet is set as used for coloration, the same processes as regarding the first color pallet 53 are executed at steps B1 to B11. In the following description, symbol p will designate a total number of the designated hue table subsequent to update of the pallet table, namely, execution of step B10.

The control device 21 proceeds to step A3 to execute a coloration process on the basis of the above-described settings regarding the selected embroidery pattern. The coloration process starts when the NEXT key 60 is touched on the range setting screen 102 (see FIG. 11). The control device 21 firstly proceeds to step C1 to calculate the combination number A of coloration based on the number of colors (set coloration manner number x) set by the color number setting part 57 and the total number n of color-based pattern portions in the selected embroidery pattern.

In the embodiment, in order that six embroidery patterns having different modes of coloration may be displayed on the thumbnail display screen 103, for example, the combination number A necessary for the display is calculated using mathematical combination. Accordingly, when the set coloration mode number x is 1 and a total number n of color-based pattern portions is also 1, for example, the combination number A is represented as pC1. The combination number A of embroidery pattern coloration modes bears a proportionate relationship to the total number p of colors in the pallet table (the designated hue table). When the total number p is not less than 2 and the set coloration mode number x is not than 3, the combination number A is not less than 6. In this case, the control device 21 determines in the negative at step C2, setting the generator so that six embroidery data are generated (step C3). Further, when determining at step C1 that the calculated combination number A is less than 6 (YES at step C2), a corresponding number of embroidery data is generated.

The control device 21 subtracts from the set coloration mode number x the number of color-based pattern portions whose colors are not desired to be changed. As a result, the control device 21 calculates the number i of types of colors to be extracted in one embroidery pattern. The control device 21 generates random numbers within the total number p of colors of the designated hue table in the color information storage area 246 and extracts colors in a random manner based on the random numbers. More specifically, when the total number p of colors of the designated hue table is 42, for example, random numbers 1 to 42 are generated (step C5). The control device 21 then checks pallet-based color numbers of the designated hue table corresponding to the generated random numbers, extracting colors (RGB values) corresponding to the relevant pallet-based color numbers (steps C6 and C7). When the extracted colors do not overlap the colors designated at step A1 (YES at step C8), the control device 21 causes the RAM 24 to store the extracted colors in the extracted data storage area 249 (step C9).

The control device 21 thus stores the extracted colors in the extracted data storage area 249 and updates the color type number i to i=i−1 every time of storage of an extracted color (step C10). Further, the control device 21 executes steps C5 to C7 regarding extraction of second and subsequent colors (YES at step C8). When the extracted second and subsequent colors do not overlap the previously extracted colors or the colors designated at step A1 (YES at step C8), the colors are stored and the subtraction of color type number i is carried out in the same manner as the first color. The control device 21 repeatedly executes the steps C5 to C10 until determining that the color type number i is not more than 0 (NO at step C11). As a result, the colors used for one embroidery pattern, that is, the colors designated at step A1 and the colors extracted at steps C5 to C11 are stored in the extracted data storage area 249 without overlap.

The control device 21 then calculates a deficiency number T that is a difference between the total color-based pattern portion number n and the set coloration mode number x (step C12). When determining that the deficiency number T is to occur (NO at step C13), the control device 21 proceeds to an additional selection process (step C14). More specifically, the control device 21 selects one or more colors from the extracted data storage area 249 at step D1 in the additional selection process in order that the color-based pattern portion number n may be equal to the number of colors in the extracted data storage area 249 on the premise of the coloration process. In this case, the control device 21 generates random numbers within the total number of colors stored in the extracted data storage area 249 in the same manner as described above, so that the control device 21 can select one or more colors from the colors in the storage area 249 in a random manner. The control device 21 additionally stores the selected colors in the extracted data storage area 249 (step D21) and updates the deficiency number T to T=T−1 (step D3). The control device 21 repeatedly executes steps D1 to D4 until determining that the deficiency number T is reduced to zero (NO at step D4). As a result, the colors the number of which is equal to the total color-based pattern portion number n are stored in the extracted data storage area 249.

Figure 13:
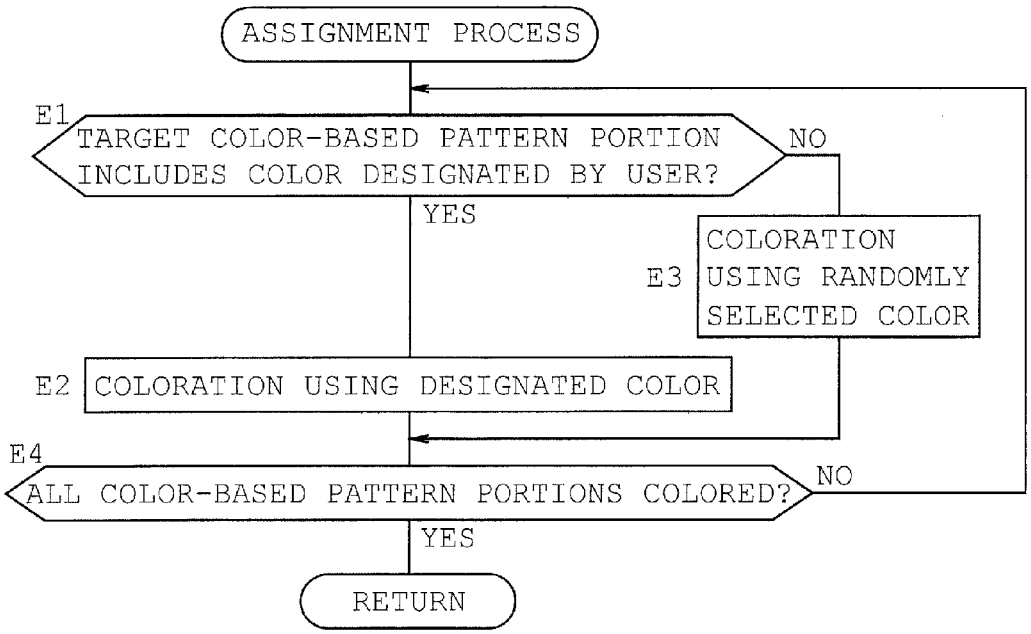
FIG. 13 is a flowchart showing an assigning process.

The control device 21 proceeds to an assignment process (step C15) when determining that the number of colors stored in the extracted data storage area 249 corresponds with the total color-based pattern portion number n (NO at step D4 or YES at step C13). In the assignment process, the control device 21 determines whether or not the user has designated a color (the designation at step A1) for every thread color data of color-based pattern portion (step E1), as shown in FIG. 13. When the thread color data contains user's designation, a corresponding color is assigned (step E3), and a color extracted in the random manner is assigned when the thread data contains no designation. In the assignment, the control device 21 shuffles the colors stored in the extracted data storage area 249. In other words, even when the additional selection process has been carried out and overlapping colors are stored in the extracted data storage area 249, a rearranging process is carried out so that a plurality of colors in the extracted data storage area 249 is taken apart, with the result that randomicity is ensured in coloration. The control device 21 thus repeats steps E1 to E4 by the number of times corresponding to the number n of color-based pattern portions and then returns to step C16 in FIG. 11 when completing coloration.

When completing coloration of the first embroidery pattern by the above-described processing, the control device 21 causes the RAM 24 to store all the thread color data (YES at step C16; and step C17). The control device 21 then updates the combination number A into A=A−1 (step C18), returning to step C4 (YES at step C19). The control device also executes steps C4 to 015 regarding coloration of second and subsequent embroidery patterns. When determining that coloration of second and subsequent embroidery patters differs from the generated coloration of the first embroidery pattern (YES at step C16), the control device 21 carries out storing of thread color data and subtraction of combination number A in the same manner as the first embroidery pattern (steps C17 and C18). The control device 21 thus repeats steps C4 to C19 until the combination number A becomes not more than 0 (NO at step C19), with the result that combination number A of embroidery patterns differing in the coloration is generated. The control device 21 subsequently returns to step A4 in FIG. 9.

The control device 21 causes the display 9 to display on the thumbnail display screen 103 the number A of thumbnail images (six in FIG. 7C) of embroidery patterns differing in the coloration. These thumbnail images have a coloration pattern within the hue range desired by the user regarding each embroidery pattern since the coloration process has been executed for the thumbnail images using the designated hue table. Accordingly, when the range from yellow to purple is designated by the hue bar 58 regarding each embroidery pattern in the manner as described above, each embroidery pattern has no rubric colors and is thus colored with less flashy feel.

When any one of the thumbnail images 61*a* of embroidery patterns is touched, the display 9 transits from the thumbnail display screen 103 to the enlarged display screen 104 (YES at step A5; and step A6). The control device 21 causes the display 9 to display the embroidery pattern obtained by enlarging the selected thumbnail image on the enlarged display screen 104. When the SET key 67 is subsequently touched, the control device 21 returns to the first color change screen 101 displaying the embroidery pattern of the enlarged image area 65 as the embroidery pattern of the preview image (END).

When the RETURN key 62 is touched on the thumbnail display screen 103 (YES at step A7), the control device 21 proceeds to step A2 where the range setting screen 102 is displayed.

Accordingly, various setting processes can be re-carried out so that the coloration process of the embroidery pattern is executed again. Further, when the REFRESH key 64 is touched (YES at step A8), the control device 21 proceeds to step A3 to execute the coloration process of the embroidery pattern again. As a result, new extracted colors are assigned to the thread color data, so that new six embroidery patterns are displayed instead of the currently displayed embroidery patterns. On the other hand, when the SAVE key 63 is touched on the thumbnail display screen 103 (YES at step A9), the control device 21 proceeds to a save mode (step A10). When any one of thumbnail images 61*a* (or a plurality of thumbnail images) is touched to be selected in the save mode, the control device 21 stores embroidery data of the embroidery pattern in the EEPROM 25 (step A11).

The control device 21 executing the steps C1 to C19, D1 to D4 and E1 to E4 serves as an extraction unit which randomly extracts colors to be used as thread color data and the assignment unit which assigns the extracted colors. The control device 21 also serves as a first display control unit and a second display unit and causes the display 9 to display the hue bar 58 serving as the color chart at step B1. The control device 21 causes the display 9 to display the embroidery pattern in the colors assigned to the thread color data of the respective color-based pattern portions at steps A4 and A6. The control device 21 and the touch panel 9*a* serve as a setting unit which sets the range on the hue bar 58. Further, the control device 21, the touch panel 9*a* and the display 9 serve as a pattern selection unit which selects a desired embroidery pattern.

The sewing machine M of the embodiment includes the first display control unit which causes the display unit to display the color chart representing at least one of the three attributes of color, that is, hue, saturation and value, the setting unit which sets a range on the color chart displayed on the display unit, the extraction unit which randomly extracts the color used as the thread color data to specify the color of color-based pattern portion from colors within the range set by the setting unit and the assignment unit which assigns the color extracted by the extraction unit for every thread color data of color-based pattern portion.

According to the above-described configuration, a desired range is set on the color chart representing at least one of the three color attributes, that is, hue, saturation and value by the setting unit. The color extracted from those in the desired range is assigned to the thread color data of color-based pattern portion, with the result that a random coloration can be carried out. Coloration involving accidentalness or unpredictable quality can be generated within the color range desired by the user with the result that a variety of color patterns can be easily obtained.

The control device 21 and the touch panel 9*a* serve as a designation unit which designates at least two points on the color chart. A range on the color chart is set based on the designated points. According to this configuration, since the two points on the color chart are designated, the range can be easily set.

The color chart is the hue bar 58 formed by developing a hue circle into a bar shape or may be a hue circle 71 as will be described with reference to FIG. 14A. Since the hue bar 58 or the hue circle 71 has a plurality of types of colors representing hue changes in orderly sequence, a hue range can be easily set. Further, an image of embroidery pattern can be varied and coloration with a sense of unity can be carried out over an entire embroidery pattern depending upon the hue range to be set.

Color extraction and color assignment are carried out by the extraction unit and the assignment unit regarding the embroidery pattern selected by the pattern selection unit, respectively. The second display control unit causes the display unit to display the embroidery pattern in the colors assigned to the thread color data of color-based pattern portions. According to this configuration, the colors of the color-based pattern portions in the generated embroidery data can be visually grasped in an easy manner.

Although the embroidery pattern before color assignment by the assignment unit and the color chart are displayed in juxtaposition on the same screen of the display 9 in the embodiment (see step B1 and FIG. 6A), the embroidery pattern after color assignment by the assignment unit and the color chart may be displayed in juxtaposition on the same screen of the display 9. Thus, the first and second display control units cause the display 9 to display the embroidery pattern before or after color assignment together with the color chart on the same screen of thereof. According to this configuration, a color range or the like can be set according to the embroidery pattern with the result of improvement in the usability of the embroidery data generator.

Figure 14A:
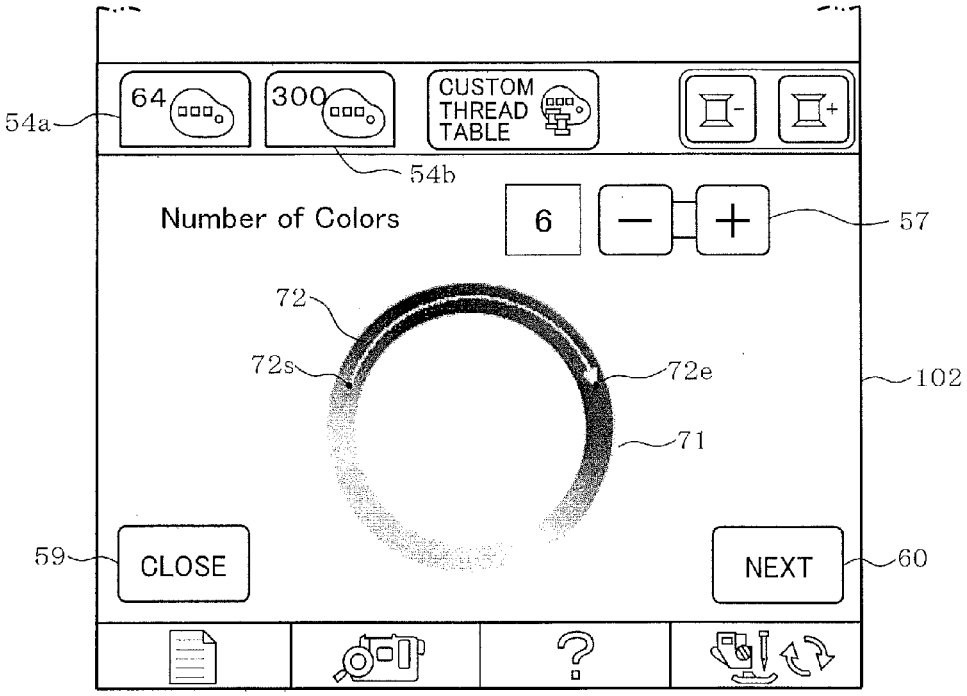
FIGS. 14A and 14B are views similar to FIGS. 6A and 6B, showing a second embodiment, respectively.
Figure 14B:
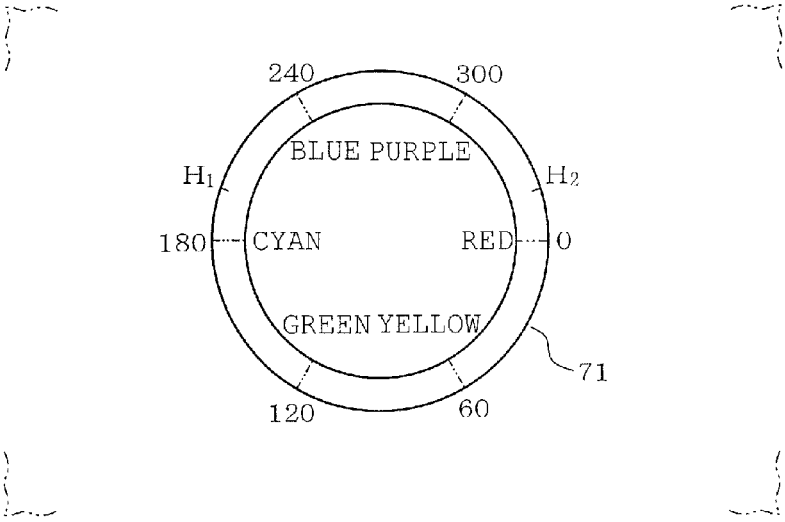

FIGS. 14A and 14B illustrate a second embodiment. Only the differences between the first and second embodiments will be described. Identical or similar parts in the second embodiment are labeled by the same reference symbols as those in the first embodiment.

The range setting screen 102 is provided with the hue circle 71 as the color chart as shown in FIG. 14A. FIG. 14B explains the hue circle 71. In the hue circle 71, numerals are arranged clockwise from "0" corresponding to red, to "60" corresponding to yellow, "120" corresponding to green, "180" corresponding to cyan, "240" corresponding to blue, "300" corresponding to purple and "360" corresponding to red again sequentially in this order. There is no demarcation between colors adjacent to each other. Accordingly, a number of types of colors representing continuous hue changes exist between the adjacent colors in the same manner as the hue bar 58. Each of saturation S and value V is set at 1.0 over an entire range of the hue circle 71.

A hue range can be set on the hue circle 71 by a swiping operation as well as the above-described touch operation to designate two points. For example, when the user swipes the hue circle 71 by a finger in a direction of arrow 72 in FIG. 14A, the control device 21 detects coordinate values of a start point and an end point of the swiping operation on the touch panel 9*a*, that is, two points (see symbols 72*s* and 72*e*) at the proximal end side and the distal end side of the arrow 72. Based on the coordinate values of the detected points and the image data of the hue circle 71, the control device 21 then specifies pixels corresponding to the respective points in the image of the hue circle 71, thereby obtaining hue values H1 and H2 of the pixels. As a result, the obtained hue values H1 and H2 are set as thresholds to determine a range on the hue circle 71.

Accordingly, the hue range can be easily set by designating two points on the hue circle 71 by the above-described operation. In particular, the hue circle 71 differs from the hue bar 58 in that the 300-degree purple is continuous with the 0-degree red in the hue circle 71. Accordingly, the range can be designated with these hue values being involved. The hue circle should not be limited to the hue circle 71 which represents continuous hue changes without demarcation between colors adjacent to each other. The hue circle may represent divided color regions of red, the yellow-red, yellow and so on, for example.

Figure 15A:
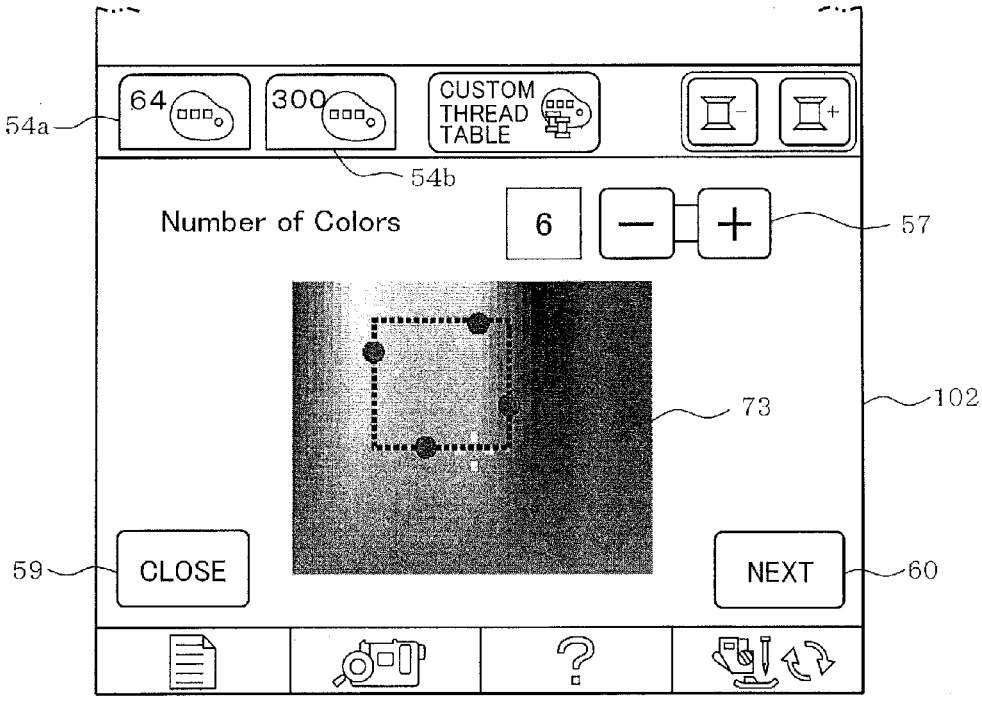
FIGS. 15A and 15B illustrate a lower half of range setting screen and a color map in the screen, showing a third embodiment, respectively.
Figure 15B:
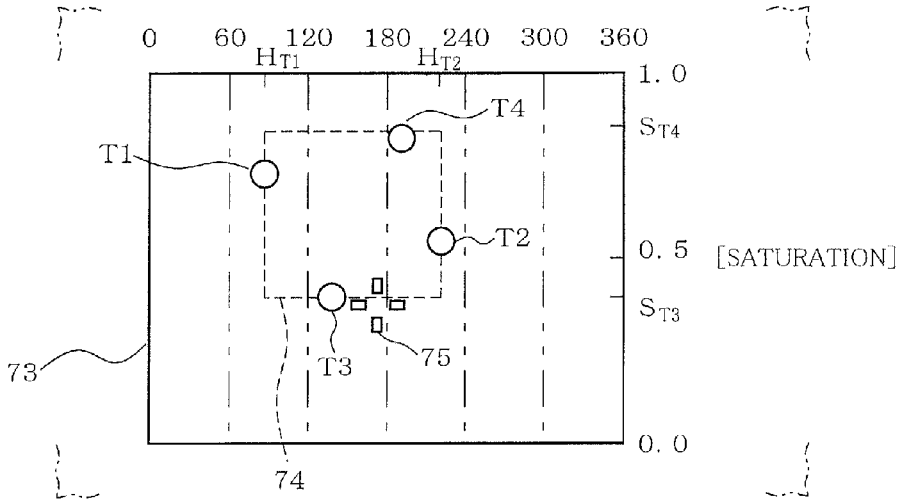
Figure 16:
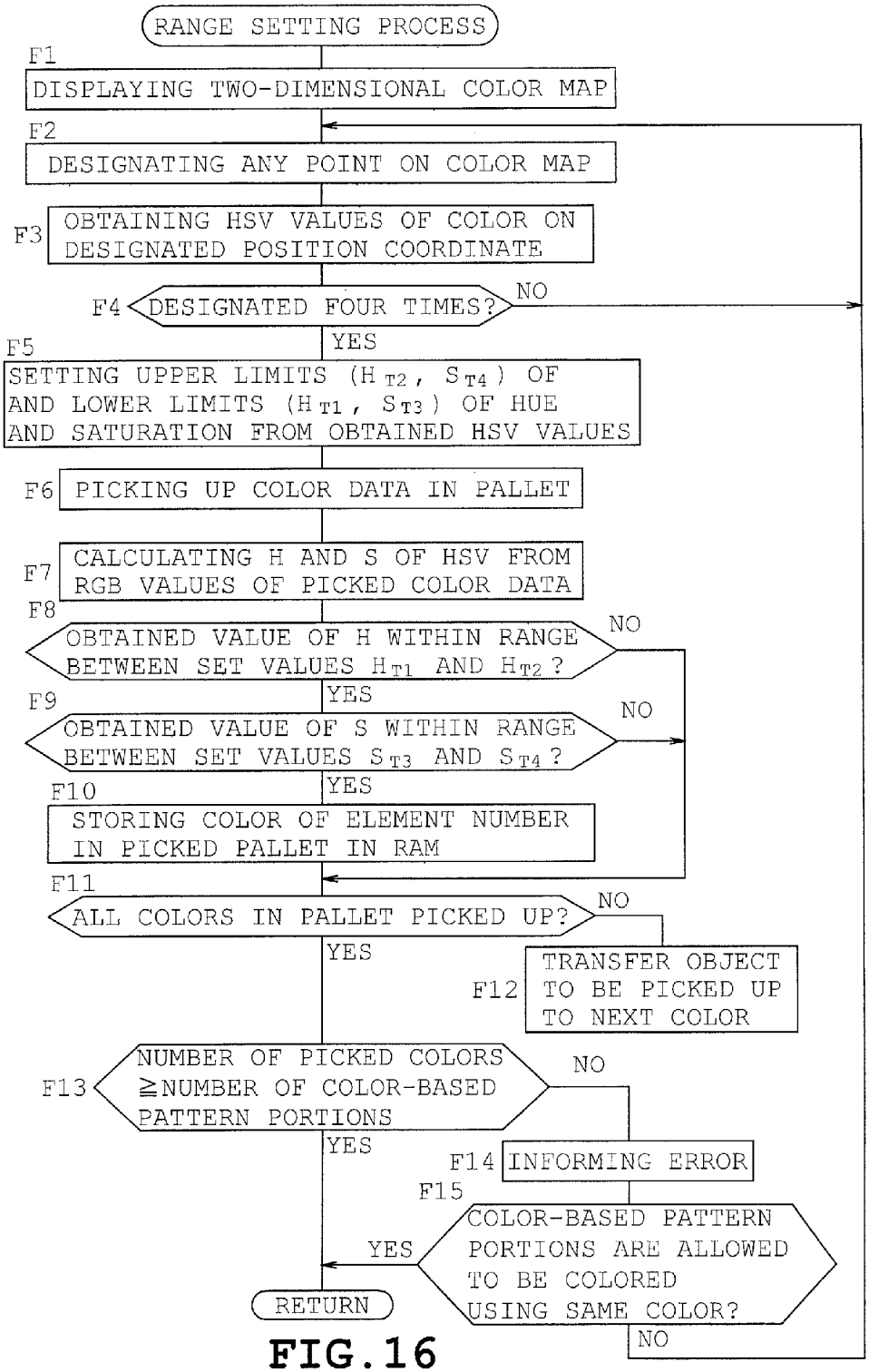
FIG. 16 is a view similar to FIG. 10.

FIGS. 15A, 15B and 16 illustrate a third embodiment. Only the differences between the first and third embodiments will be described. Identical or similar parts in the third embodiment are labeled by the same reference symbols as those in the first embodiment.

The range setting screen 102 is provided with a two-dimensional color map 73 which represents two of three attributes of color, as shown in FIG. 15A. The color map 73 is represented as a two-dimensional coordinate system having an abscissa axis indicative of hue value H and an ordinate axis indicative of saturation value S as shown in FIG. 15B. More specifically, an image of the color map 73 represents hue along the abscissa axis from the left end 0-degree to the right end 360-degree and saturation increased along the ordinate axis from the lower end "0.0" to upper end "1.0." The color map 73 has a value V of HSV, which is set at 1.0, for example.

When four points are designated on the color map 73 by the touch operation, for example, a rectangular region range 74 is displayed according to touch positions T1, T2, T3 and T4, as will be described in detail in the description of working later. The region range 74 has a left side and a right side corresponding to the touch positions T1 and T2 designating a lower limit HT1 and an upper limit HT2 of hue, respectively. The region range 74 further has a lower border and an upper border corresponding to the touch positions T3 and T4 designating a lower limit ST3 and an upper limit ST4 of saturation, respectively.

The following will describe a specific process flow using the color map 73 with reference to FIG. 16, which is a flowchart showing a flow of range setting process executed by the control device 21, instead of the above-described steps B1 to B11. The control device 21 causes the display 9 to display the color map 73 on the range setting process screen 102 (step F1). When a first touch operation is carried out on the color map 73 (step F2), a coordinate value is output from the touch panel 9*a*. In this case, the control device 21 specifies a pixel corresponding to the touch position T1 on the image of the color map 73 based on the output coordinate value and image data of the color map 73, obtaining HSV values of the pixel (step F3). When a second touch operation is then carried out on the color map 73 (NO at step F4; and step F2), the control device 21 specifies a pixel corresponding to the touch position T2 based on the output coordinate value and image data, obtaining HSV values of the pixel (step F3). The control device 21 thus repeats steps F2 and F3 until determining that the touch operation has been carried out at four times (YES at step F4).

The control device 21 sets a region range 74 of four touch positions T1 to T4 as shown in FIG. 15B on the color map 73 based on the obtained HSV values (step F5). Since the value V of HSV is constant (V=1.0) in the third embodiment, a minimum hue HT1, a maximum hue HT2, a minimum saturation ST3 and a maximum saturation ST4 are selected from the obtained HSV values and set as thresholds with respect to the region range 74. As a result, the control device 21 causes the display 9 to display a range defined by the thresholds HT1, HT2, ST3 and ST4 on the color map 73, that is, the rectangular region range 74 as shown by broken line in FIG. 15B. FIG. 15B exemplifies a case where the lower and upper limits HT1 and HT2 of hue are set by the first and second touch operations respectively and the lower and upper limits ST3 and ST4 are set by the third and fourth touch operations respectively.

For example, when the first color pallet 53 is set at step A1, the control device 21 reads RGB values corresponding to pallet-based color number 1 of the first pallet table (step F6). The control device 21 further calculates a hue value H and a saturation value S based on the RGB values (step F7). Subsequently, the control device 21 determines whether or not the obtained hue value H ranges between the thresholds HT1 and HT2 (step F8). The control device 21 further determines whether or not the obtained saturation value S ranges between the thresholds ST3 and ST4 (step F9). When determining that the hue value H ranges between the thresholds HT1 and HT2 and the saturation value S ranges between the thresholds ST3 and ST4 regarding the color of pallet-based color number 1 (YES at steps F8 and F9), the control device 21 stores the hue value H and the saturation value S in the color information storage area 246 of the RAM 24 (step F10). In other words, the color of pallet-based color number 1 is stored in the color information storage area 246 when the color corresponds to the color within the region range 74 on the color map 73.

On the other hand, assume now that the control device 21 determines that the hue value H is out of the range between thresholds HT1 and HT2 at step F8 (NO) or that the saturation value S is out of the range between thresholds ST3 and ST4 at step F9 (NO). In this case, the control device 21 proceeds to step F11 without storing the hue value H and the saturation value S in the color information storage area 246 regarding the color of pallet-based color number 1. Regarding the color of pallet-based color number 2 (NO at step F11; and step F12), the control device 21 calculates a hue value H and a saturation value S in the same manner as the pallet-based color number 1, based on the read RGB values (step F7). The control device 21 determines whether or not the hue value H ranges between the thresholds HT1 and HT2 and whether or not the saturation value S ranges between the thresholds ST3 and ST4, thereby determining whether or not the color of pallet-based color number 2 is stored in the color information storage area 246 (steps F8 and F9). The control device 21 thus repeats steps F7 to F12 regarding sixty-four colors in the first color pallet 53 and stores the color at step F10 every time determining in the affirmative at each one of steps F8 and F9. As a result, the first pallet table is updated into a designated range table of the colors within the region range designated on the color map 73. The designated range table is stored in the color information storage area 246 together with the updated pallet-based color numbers.

When completing the selection regarding all the sixty-four colors in the first color pallet 53 (YES at step F11), the control device 21 proceeds to step F13 to determine whether or not the selected color number p is not less than the total number n of color-based pattern portions. When the selected color number p is less than the total number n of color-based pattern portions (NO at step F13), the control device 21 informs the user to that effect (step F14). In other words, the selected color number p is reduced when an erroneous touch operation renders the region range 74 smaller. The control device 21 may then cause the display 9 to display the message that "a part of the embroidery pattern is colored by the same color as used in another part." with sounding of error sound.

Alternatively, the control device 21 may cause the display 9 to display an indication to encourage the user to re-designate the region range 74. Assume now that the user would carry out an input operation (a touch operation) in response to the displayed contents. In this case, the control device 21 returns to step A3 in FIG. 9 when determining that coloration using the same color between or among the color-based pattern portions is to be executed, based on the touch operation or the comparison between the set color combination number x and the selected color number p (YES at step F15). On the other hand, the control device 21 returns to step F2 when determining that coloration using no same color between or among the color-based pattern portions is to be executed (NO at step F15). Accordingly, the user can designate the region range 74 again.

It is only necessary to execute the informing at step F14 when the selected color number p is smaller than the total number n of color-based pattern portions. For example, when the selected color number p is less than the total number n of color-based pattern portions, the control device 21 may return from step F15 to step F2 unconditionally.

Further, although the touch positions T1 to T4 are not displayed on the color map 73, a cross-shaped cursor 75 as shown in FIG. 15B may be displayed as an input position (a touch point), for example. Still further, a mouse may be detachably connected to a connector (not shown) provided on a side surface of the pillar 2 so as to be operable with the cursor 75 serving as a mouse cursor to set the region range 74.

The color map 73 in the third embodiment is represented as a two-dimensional coordinate system having two coordinate axes indicative of hue and saturation as described above. According to this configuration, the range on the color map 73 can be easily set regarding the attributes of hue and saturation with the result that user's color preference can be better reflected on the coloration of embroidery pattern.

The control device 21, the display 9 and the drive circuit 34 serve as the informing unit which informs that the extractable number of colors is smaller than the number of thread color data of the color-based pattern portions when a color belonging to the range (the region range 74) designated by the designation unit is extracted from the color information stored in the storage unit by the extraction unit.

Steps F13 to F15 relating to the informing operation may be executed with respect to another color chart (after step B10 in the case of the hue bar 58) as well as the color map 73.

According to this configuration, an error in setting the range on the color chart can be informed and a suitable range according to the embroidery pattern (the number of thread color data of color-based pattern portions) can be set.

The foregoing embodiments should not be restrictive but may be modified or expanded as follows.

The embroidery data generator should not be limited to the construction provided in the sewing machine M but may be composed of a generator body which is a personal computer (a dedicated machine), a mouse, a keyboard, a memory card connector and a display all connected to the body, and the like. Further, when the sewing machine M and the embroidery data generator are constructed independently of each other, the sewing machine M and the embroidery data generator may be connected to each other in a wired or wireless connection manner so that data is transmitted and received therebetween.

The color chart represented by the two-dimensional coordinated system should not be limited to the color map 73 but may be a two-dimensional color map having two coordinate axes indicative of hue and saturation. In this case, the color map has an abscissa axis indicative of hue value H from 0 to 360 and an ordinate axis indicative of value V from 0.0 to 1.0 with saturation S being constant (1.0, for example). According to this configuration, the range can be easily set on the color map regarding the attributes of hue and saturation. Further, user's color preference can be better reflected on the coloration of embroidery pattern. Thus, this modified form can achieve the same effect as the third embodiment.

The setting unit and the designation unit should not be limited to the respective above-described configurations. For example, when two points are designated on the two-dimensional color map 73 by touch operation in the third embodiment, a rectangle having a diagonal obtained by connecting the points may be set as the region range 74.

The storage unit should not be limited to the RAM 24 and the EEPROM 25 but may be another internal storage unit incorporated in the sewing machine or the embroidery data generator or an external storage unit detachably attachable to the sewing machine or the embroidery data generator.

A storage medium storing the embroidery data generating program should not be limited to the ROM 23 but may be a USE memory, a CD-ROM, a flexible disc, a DVD, a memory card or the like. In this case, the embroidery data generating program may be read by a computer such as the foregoing dedicated machine to be executed. As a result, this modification can achieve the same working and advantageous effect each as that achieved by the foregoing embodiment.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An embroidery data generator generating embroidery data on which an embroidery pattern is sewn, the generator comprising:

a display unit configured to be capable of color display; and a control device configured to:

cause the display unit to display a color chart representing at least one of three attributes of hue, saturation and value of a color in an HSV color space;

set a range on the displayed color chart;

randomly extract one of colors within the set range, the one color being used as thread color data, the embroidery pattern including a plurality of color-based pattern portions, the thread color data specifying colors of the color-based pattern portions; and assign the extracted color to the thread color data of a corresponding one of the color-based pattern portions.

2. The generator according to claim 1, further comprising a designation unit configured to designate at least two points on the color chart and to set the range based on the designated points.

3. The generator according to claim 2, wherein the color chart is a hue circle or a hue bar formed by developing the hue circle into a bar shape.

4. The generator according to claim 2, wherein the color chart is a two-dimensional chart having two coordinate axes indicative of hue and saturation or hue and value in the HSV color space respectively.

5. The generator according to claim 2, further comprising:

a storage unit configured to store a plurality of pieces of predefined color information; and an informing unit configured to be capable of informing of information, wherein the control device is further configured to:

compare a number of extractable colors with a number of the thread color data of the color-based pattern portions when the colors corresponding to colors within the designated range are extracted from the pieces of color information in the storage unit; and cause the informing unit to inform that the number of extractable colors is smaller, when the number of extractable colors is smaller than the number of the thread color data of the color-based pattern portions.

6. The generator according to claim 1, wherein the color chart is a hue circle or a hue bar formed by developing the hue circle into a bar shape.

7. The generator according to claim 1, wherein the color chart is a two-dimensional chart having two coordinate axes indicative of hue and saturation or hue and value in the HSV color space respectively.

8. The generator according to claim 1, further comprising:

a pattern selection unit configured to select a desired one of a plurality of embroidery patterns, wherein the control device is further configured to:

randomly extract a plurality of colors used as thread color data of the selected embroidery pattern respectively;

assign the extracted colors to the thread color data of a plurality of color-based pattern portions of the selected embroidery pattern respectively; and cause the display unit to display the selected embroidery pattern in the colors assigned to the thread color data of the color-based pattern portions respectively.

9. The generator according to claim 8, wherein the display unit includes a display and the control device is further configured to cause the display to display the selected embroidery pattern before or after the color assignment and the color chart in juxtaposition on a same screen of the display.

10. A non-transitory computer-readable storage medium storing a program for an embroidery data generator including a display unit capable of color display and a control device, the program causing the control device to execute instructions which, when executed, cause the control device to:

cause the display unit to display a color chart representing at least one of three attributes of hue, saturation and value of a color in an HSV color space;

set a range on the color chart displayed by the display unit;

randomly extract one of colors within the set range, the one color being used as thread color data, the embroidery pattern including a plurality of color-based pattern portions, the thread color data specifying colors of the color-based pattern portions; and assign the extracted color to the thread color data of a corresponding one of the color-based pattern portions.

11. A sewing machine comprising:

a sewing unit capable of executing sewing on a workpiece cloth;

a display unit capable of color display; and a control device configured to:

cause the display unit to display a color chart representing at least one of three attributes of hue, saturation and value of a color in an HSV color space;

set a range on the color chart displayed by the display unit;

randomly extract one of colors within the set range, the one color being used as thread color data, the embroidery pattern including a plurality of color-based pattern portions, the thread color data specifying colors of the color-based pattern portions;

assign the extracted color to the thread color data of a corresponding one of the color-based pattern portions; and control the sewing unit so that an embroidery pattern is sewn on the workpiece cloth, based on embroidery data of the embroidery pattern including color-based pattern portions to which the extracted colors have been assigned respectively.

* * * * *